US011769456B2

(12) United States Patent
Choe et al.

(10) Patent No.: US 11,769,456 B2
(45) Date of Patent: Sep. 26, 2023

(54) DISPLAY DEVICE

(71) Applicant: Samsung Display Co., Ltd., Yongin-si (KR)

(72) Inventors: Younwoo Choe, Asan-si (KR); Seung-Kyu Lee, Asan-si (KR); Minseong Son, Yongin-si (KR); Semin Jeong, Pyeongtaek-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/857,437

(22) Filed: Jul. 5, 2022

(65) Prior Publication Data

US 2023/0005431 A1 Jan. 5, 2023

(30) Foreign Application Priority Data

Jul. 5, 2021 (KR) ..... 10-2021-0088074

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/0426* (2013.01); *G09G 2300/0842* (2013.01); *G09G 2310/0278* (2013.01); *G09G 2310/061* (2013.01)

(58) Field of Classification Search
None
See application file for complete search history.

(56) References Cited

U.S. PATENT DOCUMENTS

| | | | | |
|---|---|---|---|---|
| 10,916,198 | B2 | 2/2021 | Lin et al. | |
| 10,930,724 | B2 | 2/2021 | Ka et al. | |
| 2020/0226978 | A1* | 7/2020 | Lin | G09G 3/3258 |
| 2021/0241687 | A1* | 8/2021 | Xie | G09G 3/3233 |

FOREIGN PATENT DOCUMENTS

| | | | |
|---|---|---|---|
| KR | 1020180004369 | A | 1/2018 |
| KR | 1020200087711 | A | 7/2020 |

* cited by examiner

*Primary Examiner* — Michael A Faragalla
(74) *Attorney, Agent, or Firm* — CANTOR COLBURN LLP

(57) ABSTRACT

A display device includes a display panel including a pixel connected to scan lines and a data line, a scan driving circuit, a data driving circuit, and a driving controller that controls the scan driving circuit and the data driving circuit. The pixel includes a light-emitting diode and an initialization transistor connected between a first initialization voltage line and a first electrode of the light-emitting diode and including a gate electrode connected to a first scan line among the scan lines. A first scan signal provided to the first scan line during a blank period has an active level during a predetermined initialization time duration, and the predetermined initialization time duration is set to a time duration corresponding to a luminance characteristic of the display panel.

20 Claims, 16 Drawing Sheets

DISPLAY DEVICE

This application claims priority to Korean Patent Application No. 10-2021-0088074, filed on Jul. 5, 2021, and all the benefits accruing therefrom under 35 U.S.C. § 119, the content of which in its entirety is herein incorporated by reference.

BACKGROUND

1. Field

Embodiments of the invention herein relate to a display device.

2. Description of the Related Art

An organic light-emitting display device among display devices displays an image by an organic light-emitting diode that generates light by the recombination of electrons and holes. The organic light-emitting display device has a fast response speed and is driven with low power consumption.

The organic light-emitting display device includes pixels connected to data lines and scan lines. In general, the pixels include an organic light-emitting diode and a pixel circuit that controls an amount of current flowing into the organic light-emitting diode. The organic light-emitting diode generates light of a predetermined luminance corresponding to the amount of current transmitted from the pixel circuit.

SUMMARY

Embodiments of the invention provide a display device having the improved display quality of an image.

In an embodiment, a display device includes a plurality of scan lines, a data line, a display panel including a pixel connected to the plurality of scan lines and the data line, a scan driving circuit that outputs a plurality of scan signals to the plurality of scan lines, respectively, a data driving circuit that outputs a data signal to the data line during an active period, and a driving controller that controls the scan driving circuit and the data driving circuit. The pixel includes a light-emitting diode including a first electrode and a second electrode and an initialization transistor connected between a first initialization voltage line and the first electrode of the light-emitting diode and including a gate electrode connected to a first scan line among the plurality of scan lines. A first scan signal among the plurality of scan signals provided to the first scan line during a blank period has an active level during a predetermined initialization time duration, and the predetermined initialization time duration is set to a time duration corresponding to a luminance characteristic of the display panel.

In an embodiment, when the luminance characteristic of the display panel has a first value, the predetermined initialization time duration of the first scan signal may have a first time duration during the blank period. When the luminance characteristic of the display panel has a second value different from the first value, the predetermined initialization time duration of the first scan signal may have a second time duration different from the first time duration during the blank period.

In an embodiment, an initialization voltage provided to the first initialization voltage line may have a voltage level corresponding to the luminance characteristic of the display panel.

In an embodiment, when the luminance characteristic of the display panel has a first value, the initialization voltage may have a first voltage level. When the luminance characteristic of the display panel has a second value different from the first value, the initialization voltage may have a second voltage level different from the first voltage level.

In an embodiment, the pixel may further include a first transistor including a first electrode, a second electrode electrically connected to the first electrode of the light-emitting diode, and a gate electrode and a switching transistor including a first electrode connected to a bias voltage line, a second electrode connected to the first electrode of the first transistor, and a gate electrode connected to the first scan line.

In an embodiment, the pixel may further include a second transistor including a first electrode connected to the data line, a second electrode connected to the first electrode of the first transistor, and a gate electrode connected to a second scan line among the plurality of scan lines, a third transistor including a first electrode connected to the second electrode of the first transistor, a second electrode connected to the gate electrode of the first transistor, and a gate electrode connected to a third scan line among the plurality of scan lines, a fourth transistor including a first electrode connected to the gate electrode of the first transistor, a second electrode connected to a second initialization voltage line, and a gate electrode connected to a fourth scan line among the plurality of scan lines, a fifth transistor including a first electrode connected to a voltage line, a second electrode connected to the first electrode of the first transistor, and a gate electrode for receiving a light-emitting control signal, a sixth transistor including a first electrode connected to the second electrode of the first transistor, a second electrode connected to the first electrode of the light-emitting diode, and a gate electrode for receiving the light-emitting control signal, and a capacitor including a first terminal connected to the voltage line and a second terminal connected to the gate electrode of the first transistor.

In an embodiment, at least one of the first transistor, the second transistor, the third transistor, the fourth transistor, the fifth transistor, the sixth transistor, the initialization transistor, and the switching transistor may be an N-type transistor, and remaining transistors of the first transistor, the second transistor, the third transistor, the fourth transistor, the fifth transistor, the sixth transistor, the initialization transistor, and the switching transistor may be P-type transistors.

In an embodiment, each of the first transistor, the second transistor, the fifth transistor, the sixth transistor, the initialization transistor, and the switching transistor may be a P-type transistor, and each of the third transistor and the fourth transistor may be an N-type transistor.

In an embodiment, each of a second scan signal, a third scan signal, and a fourth scan signal among the plurality of scan signals, which are respectively provided to the second scan line, the third scan line, and the fourth scan line, may be at an inactive level during the blank period.

In an embodiment, the second scan signal provided to the second scan line is at an active level during one horizontal period in the active period. The predetermined initialization time duration of the first scan signal provided to the first scan line during the blank period may be longer than the one horizontal period.

In an embodiment, when an operating frequency of the second scan signal is a first frequency, one frame may include the active period. When the operating frequency of the second scan signal is a second frequency lower than the first frequency, one frame may include the active period and the blank period.

In an embodiment, a display device includes a plurality of scan lines, a data line, a display panel including a pixel connected to the plurality of scan lines and the data line, a scan driving circuit that outputs a plurality of scan signals to the plurality of scan lines, respectively, a data driving circuit that outputs a data signal to the data line, and a driving controller that controls the scan driving circuit and the data driving circuit. The pixel includes a light-emitting diode including a first electrode and a second electrode, an initialization transistor connected between a first initialization voltage line and the first electrode of the light-emitting diode and including a gate electrode connected to a first scan line among the plurality of scan lines, a first transistor including a first electrode, a second electrode electrically connected to the first electrode of the light-emitting diode, and a gate electrode, and a second transistor including a first electrode connected to the data line, a second electrode connected to the first electrode of the first transistor, and a gate electrode connected to a second scan line among the plurality of scan lines. One frame includes an active period and a blank period. A first scan signal among the plurality of scan signals provided to the first scan line during the blank period has an active level during a predetermined initialization time duration, and the predetermined initialization time duration is set to a time duration corresponding to a luminance characteristic of the display panel.

In an embodiment, when the luminance characteristic of the display panel has a first value, the predetermined initialization time duration of the first scan signal may have a first time duration during the blank period. When the luminance characteristic of the display panel has a second value different from the first value, the predetermined initialization time duration of the first scan signal may have a second time duration different from the first time duration during the blank period.

In an embodiment, an initialization voltage provided to the first initialization voltage line may have a voltage level corresponding to the luminance characteristic of the display panel.

In an embodiment, when the luminance characteristic of the display panel has a first value, the initialization voltage may have a first voltage level. When the luminance characteristic of the display panel has a second value different from the first value, the initialization voltage may have a second voltage level different from the first voltage level.

In an embodiment, the pixel may further include a switching transistor including a first electrode connected to a bias voltage line, a second electrode connected to the first electrode of the first transistor, and a gate electrode connected to the first scan line.

In an embodiment, the pixel may further include a third transistor including a first electrode connected to the second electrode of the first transistor, a second electrode connected to the gate electrode of the first transistor, and a gate electrode connected to a third scan line among the plurality of scan lines, a fourth transistor including a first electrode connected to the gate electrode of the first transistor, a second electrode connected to a second initialization voltage line, and a gate electrode connected to a fourth scan line among the plurality of scan lines, a fifth transistor including a first electrode connected to a voltage line, a second electrode connected to the first electrode of the first transistor, and a gate electrode for receiving a light-emitting control signal, a sixth transistor including a first electrode connected to the second electrode of the first transistor, a second electrode connected to the first electrode of the light-emitting diode, and a gate electrode for receiving the light-emitting control signal, and a capacitor including a first terminal connected to the voltage line and a second terminal connected to the gate electrode of the first transistor.

In an embodiment, at least one of the first transistor, the second transistor, the third transistor, the fourth transistor, the fifth transistor, the sixth transistor, the initialization transistor, and the switching transistor may be an N-type transistor, and remaining transistors of the first transistor, the second transistor, the third transistor, the fourth transistor, the fifth transistor, the sixth transistor, the initialization transistor, and the switching transistor may be P-type transistors.

In an embodiment, each of a second scan signal, a third scan signal, and a fourth scan signal among the plurality of scan signals, which are respectively provided to the second scan line, the third scan line, and the fourth scan line, may be at an inactive level during the blank period.

In an embodiment, the second scan signal provided to the second scan line is at an active level during one horizontal period in the active period. The predetermined initialization time duration of the first scan signal provided to the first scan line during the blank period may be longer than the one horizontal period.

BRIEF DESCRIPTION OF THE DRAWINGS

The above and other objects and features of the invention will become apparent by describing in detail embodiments thereof with reference to the accompanying drawings.

DETAILED DESCRIPTION

Figure 1:
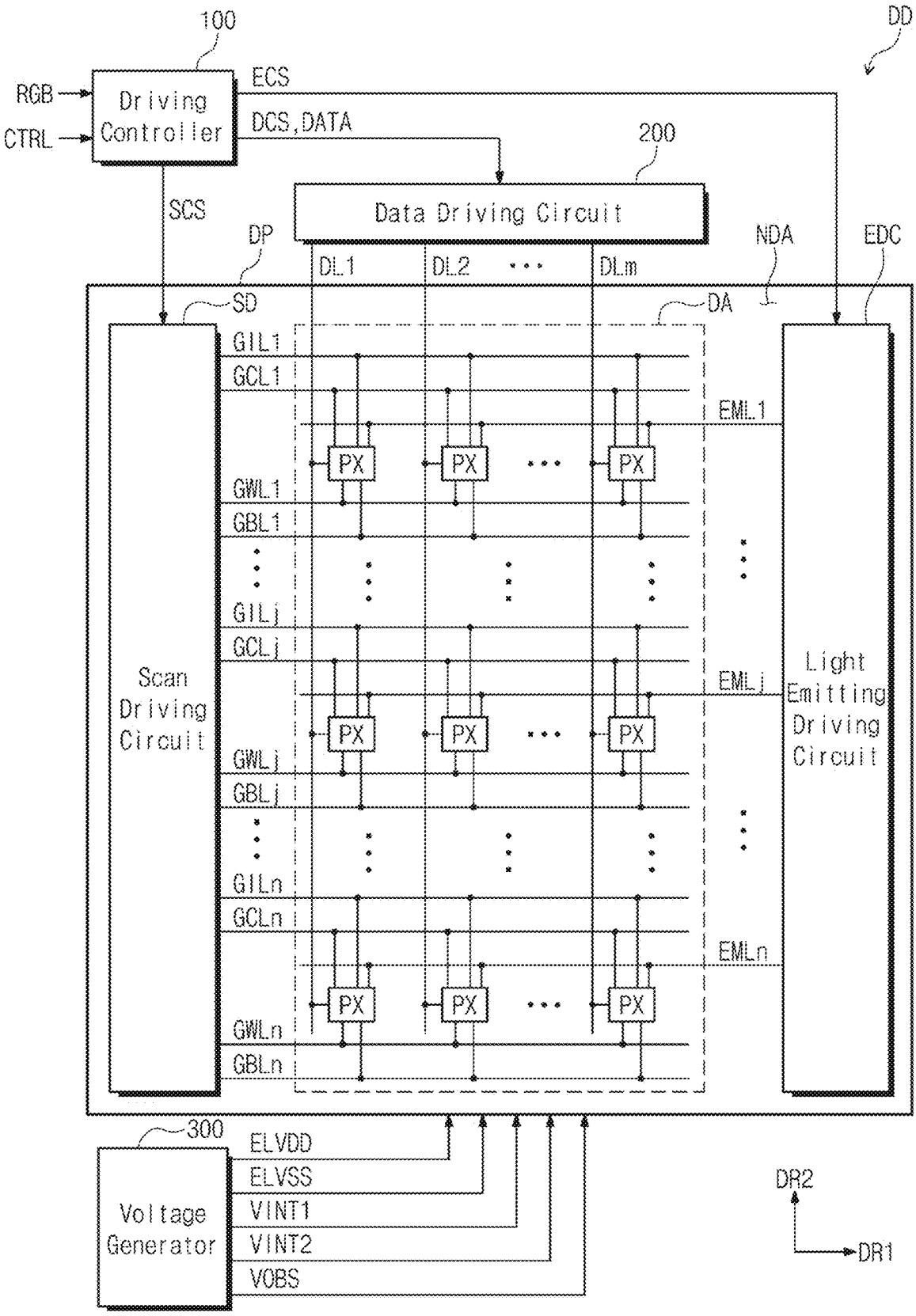
FIG. 1 is a block diagram of an embodiment of a display device, according to the invention.

In the specification, the expression that a first component (or region, layer, part, etc.) is "on", "connected with", or "coupled with" a second component means that the first component is directly on, connected with, or coupled with the second component or means that a third component is interposed therebetween.

Like reference numerals refer to like components. Also, in drawings, the thickness, ratio, and dimension of components may be exaggerated for effectiveness of description of technical contents. The term "and/or" includes one or more combinations of the associated listed items.

The terms "first", "second", etc. are used to describe various components, but the components are not limited by the terms. The terms are used only to differentiate one component from another component. For example, a first component may be named as a second component, and vice versa, without departing from the spirit or scope of the invention. A singular form, unless otherwise stated, includes a plural form.

Also, the terms "under", "beneath", "on", "above", etc. are used to describe a relationship between components illustrated in a drawing. The terms are relative and are described with reference to a direction indicated in the drawing.

It will be understood that the terms "include", "comprise", "have", etc. specify the presence of features, numbers, steps, operations, elements, or components, described in the specification, or a combination thereof, not precluding the presence or additional possibility of one or more other features, numbers, steps, operations, elements, or components or a combination thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30 percent (%), 20%, 10%, or 5% of the stated value, for example.

Unless otherwise defined, all terms (including technical terms and scientific terms) used in this specification have the same meaning as commonly understood by those skilled in the art to which the disclosure belongs. Furthermore, terms such as terms defined in the dictionaries commonly used should be interpreted as having a meaning consistent with their meaning in the context of the related technology, and should not be interpreted in ideal or overly formal meanings unless explicitly defined herein.

Hereinafter, embodiments of the invention will be described with reference to accompanying drawings.

FIG. 1 is a block diagram of an embodiment of a display device DD, according to the invention.

Referring to FIG. 1, a display device DD in an embodiment of the invention may be a portable terminal such as a tablet personal computer ("PC"), a smartphone, a personal digital assistant ("PDA"), a portable multimedia player ("PMP"), a game console, a wristwatch-type electronic device, or the like. However, the invention is not limited thereto. Embodiments of the invention may be used for small and medium electronic devices such as a personal computer, a notebook computer, a kiosk, a car navigation unit, and a camera, in addition to large-sized electronic equipment such as a television or an outside billboard. The above examples are provided only as an embodiment, and it is obvious that the display device DD may be applied to any other electronic device(s) without departing from the concept of the invention.

The display device DD includes a display panel DP, a driving controller 100, a data driving circuit 200, and a voltage generator 300.

The driving controller 100 receives an image signal RGB and a control signal CTRL. The driving controller 100 generates image data signal DATA by converting a data format of the image signal RGB so as to be suitable for the interface specification of the data driving circuit 200. The driving controller 100 outputs a scan control signal SCS, a data control signal DCS, and a light-emitting driving signal ECS.

The data driving circuit 200 receives the data control signal DCS and the image data signal DATA from the driving controller 100. The data driving circuit 200 converts the image data signal DATA into data signals and then outputs the data signals to a plurality of data lines DL1 to DLm (m is a natural number greater than zero) to be described later. The data signals are analog voltages corresponding to grayscale values of the image data signal DATA.

The voltage generator 300 generates voltages necessary to operate the display panel DP. In an embodiment, the voltage generator 300 generates a first driving voltage ELVDD, a second driving voltage ELVSS, a first initialization voltage VINT1, a second initialization voltage VINT2, and a bias voltage VOBS.

The display panel DP includes scan lines GIL1 to GILn (n is a natural number greater than zero), GCL1 to GCLn, GWL1 to GWLn, and GBL1 to GBLn, light-emitting control lines EML1 to EMLn, the data lines DL1 to DLm and pixels PX. The display panel DP may further include a scan driving circuit SD and a light-emitting driving circuit EDC.

The display panel DP may be divided into a display area DA and a non-display area NDA surrounding the display area DA. The pixels PX may be disposed in the display area DA. The scan driving circuit SD and the light-emitting driving circuit EDC may be disposed in the non-display area NDA.

In an embodiment, the scan driving circuit SD may be arranged on a first side (e.g., left side in FIG. 1) of the display panel DP. The scan lines GIL1 to GILn, GCL1 to GCLn, GWL1 to GWLn, and GBL1 to GBLn extend from the scan driving circuit SD in a first direction DR1.

The light-emitting driving circuit EDC is arranged on a second side (e.g., right side in FIG. 1) of the display panel DP. The light-emitting control lines EML1 to EMLn extend from the light-emitting driving circuit EDC in a direction opposite to the first direction DR1. The light-emitting driving circuit EDC may receive the light-emitting driving signal ECS from the driving controller 100 and then may output light-emitting control signals to light-emitting control lines EML1 to EMLn.

The scan lines GIL1 to GILn, GCL1 to GCLn, GWL1 to GWLn, and GBL1 to GBLn and the light-emitting control lines EML1 to EMLn are arranged to be spaced from one another in a second direction DR2. The data lines DL1 to DLm extend from the data driving circuit 200 in a direction opposite to the second direction DR2, and are arranged spaced from one another in the first direction DR1.

In the embodiment shown in FIG. 1, the scan driving circuit SD and the light-emitting driving circuit EDC are arranged to face each other with the pixels PX interposed therebetween, but the invention is not limited thereto. In an embodiment, the scan driving circuit SD and the light-emitting driving circuit EDC may be disposed adjacent to each other on one of the first side and the second side of the display panel DP, for example. In an embodiment, the scan driving circuit SD and the light-emitting driving circuit EDC may be implemented with one circuit.

The plurality of pixels PX is electrically connected to corresponding scan lines among the scan lines GIL1 to GILn, GCL1 to GCLn, GWL1 to GWLn, and GBL1 to GBLn, corresponding light-emitting control lines among the light-emitting control lines EML1 to EMLn, and corresponding data lines among the data lines DL1 to DLm. Each of the plurality of pixels PX may be electrically connected to four scan lines and one light-emitting control line. In an embodiment, as shown in FIG. 1, pixels PX in a first row may be connected to the scan lines GILL GCL1, GWL1, and GBL1 and the light-emitting control line EML1, for example. Furthermore, pixels PX in a j-th row may be connected to the scan lines GILj, GCLj, GWLj, and GBLj and the light-emitting control line EMLj.

Each of the plurality of pixels PX includes a light-emitting diode ED (refer to FIG. 2) and a pixel circuit unit for controlling light emission of the light-emitting diode ED. The pixel circuit unit may include one or more transistors and one or more capacitors. The scan driving circuit SD and the light-emitting driving circuit EDC may include transistors formed or provided through the same process as that of the pixel circuit unit PXC.

Each of the plurality of pixels PX receives the first driving voltage ELVDD, the second driving voltage ELVSS, the first initialization voltage VINT1, and the second initialization voltage VINT2 from the voltage generator 300.

The scan driving circuit SD receives the scan control signal SCS from the driving controller 100. The scan driving circuit SD may output scan signals to the scan lines GIL1 to GILn, GCL1 to GCLn, GWL1 to GWLn, and GBL1 to GBLn in response to the scan control signal SCS. The circuit configuration and operation of the scan driving circuit SD will be described in detail later.

The driving controller 100 in an embodiment of the invention may determine an operating frequency and may control the data driving circuit 200, the scan driving circuit SD, and the light-emitting driving circuit EDC depending on the determined operating frequency. The driving controller 100 in an embodiment may variously change an operating frequency such as about 240 hertz (Hz), about 120 Hz, about 60 Hz, about 10 Hz, or the like.

Figure 2:
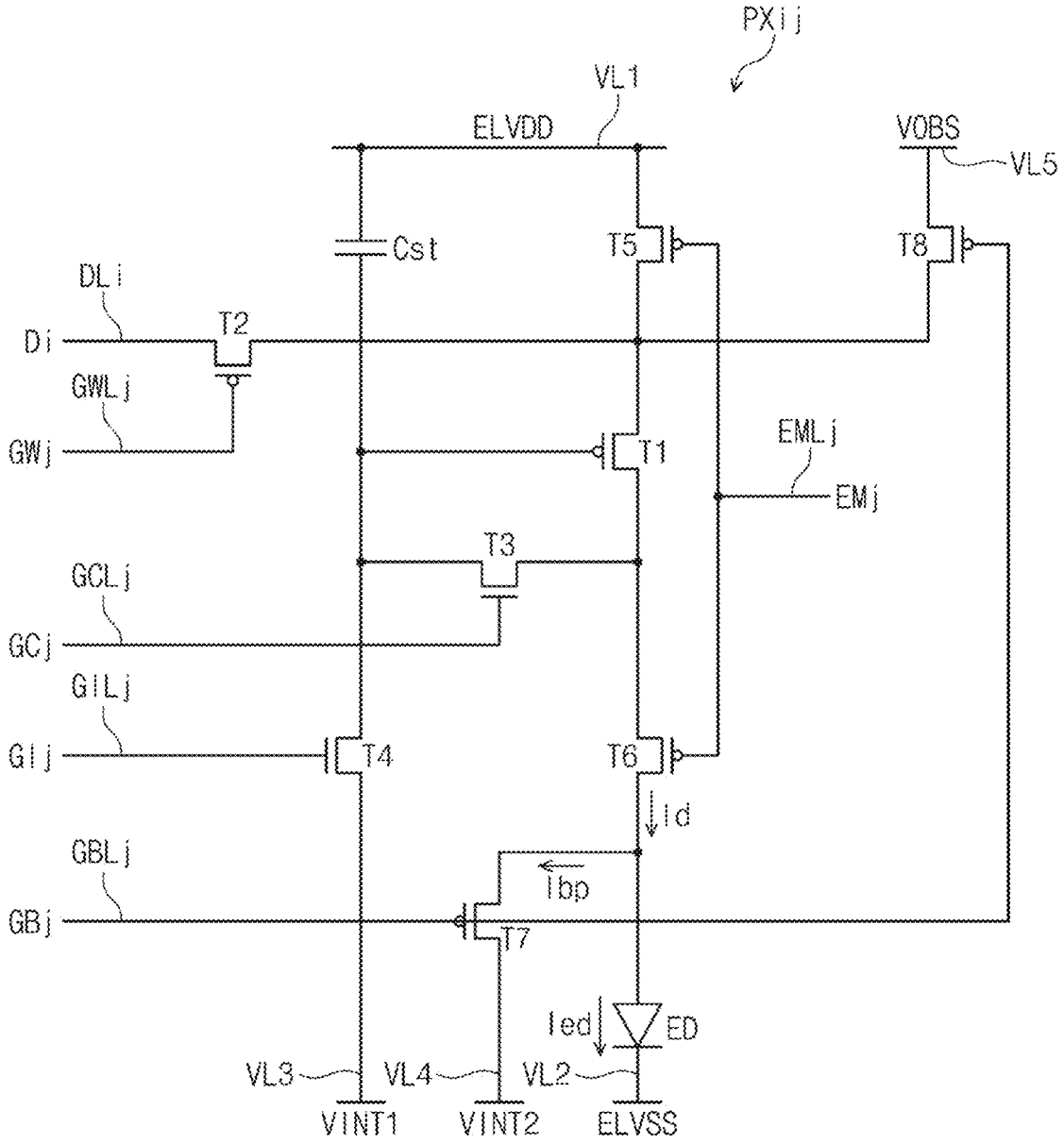
FIG. 2 is an equivalent circuit diagram of an embodiment of a pixel, according to the invention.

FIG. 2 is an equivalent circuit diagram of an embodiment of a pixel PX, according to the invention.

FIG. 2 illustrates an equivalent circuit diagram of a pixel PXij connected to the i-th data line DLi (i is a natural number equal to or less than m and greater than zero) among the data lines DL1 to DLm, the j-th scan lines GILj, GCLj, GWLj, and GBLj (j is a natural number equal to or less than n and greater than zero) among the scan lines GIL1 to GILn, GCL1 to GCLn, GWL1 to GWLn, and GBL1 to GBLn and the j-th light-emitting control line EMLj among the light-emitting control lines EML1 to EMLn, which are illustrated in FIG. 1.

Each of the plurality of pixels PX shown in FIG. 1 may have the same circuit configuration as the equivalent circuit diagram of the pixel PXij shown in FIG. 2.

The pixel PXij of the display device DD in an embodiment includes first to eighth transistors T1, T2, T3, T4, T5, T6, T7, and T8, a capacitor Cst, and at least one light-emitting diode ED. In an embodiment, it is described that the one pixel PXij includes one light-emitting diode ED, but the invention is not limited thereto.

In an embodiment, the third and fourth transistors T3 and T4 among the first to eighth transistors T1 to T8 are N-type transistors using an oxide semiconductor as a semiconductor layer. Each of the first, second, fifth, sixth, seventh, and eighth transistors T1, T2, T5, T6, T7, and T8 is a P-type transistor having a low-temperature polycrystalline silicon ("LTPS") semiconductor layer. However, the invention is not limited thereto, and all of the first to eighth transistors T1 to T8 may be P-type transistors or N-type transistors. In an embodiment, at least one of the first to eighth transistors T1 to T8 may be an N-type transistor, and the remaining transistors may be P-type transistors. Moreover, the circuit configuration of a pixel PX in an embodiment of the invention is not limited to FIG. 2. The pixel PXij illustrated in FIG. 2 is only an example, and the circuit configuration of the pixel PXij may be modified and implemented.

Referring to FIG. 2, the scan lines GILj, GCLj, GWLj, and GBLj may transmit scan signals GIj, GCj, GWj, and GBj, respectively. The light-emitting control line EMLj may transmit a light-emitting control signal EMj. The data line DLi transmits a data signal Di. The data signal Di may have a voltage level corresponding to the image signal RGB input to the display device DD (refer to FIG. 1). First to fourth voltage lines VL1, VL2, VL3, and VL4 may transmit the first driving voltage ELVDD, the second driving voltage ELVSS, the first initialization voltage VINT1, and the second initialization voltage VINT2, respectively.

The first transistor T1 includes a first electrode connected to the first voltage line VL1 via the fifth transistor T5, a second electrode electrically connected to an anode of the light-emitting diode ED via the sixth transistor T6, and a gate electrode connected to one end of the capacitor Cst. The first transistor T1 may receive the data signal Di transmitted by the data line DLi depending on the switching operation of the second transistor T2 and then may supply a driving current Id to the light-emitting diode ED.

The second transistor T2 includes a first electrode connected to the data line DLi, a second electrode connected to the first electrode of the first transistor T1, and a gate electrode connected to the scan line GWLj. The second transistor T2 may be turned on depending on the scan signal GWj received through the scan line GWLj and then may transmit the data signal Di transmitted from the data line DLi to the first electrode of the first transistor T1.

The third transistor T3 includes a first electrode connected to the gate electrode of the first transistor T1, a second electrode connected to the second electrode of the first transistor T1, and a gate electrode connected to the scan line GCLj. The third transistor T3 may be turned on depending on the scan signal GCj received through the scan line GCLj, and thus, the gate electrode and the second electrode of the first transistor T1 may be connected, that is, the first transistor T1 may be diode-connected.

The fourth transistor T4 includes a first electrode connected to the gate electrode of the first transistor T1, a second electrode connected to the third voltage line (also referred to as a second initialization voltage line) VL3 through which the first initialization voltage VINT' is supplied, and a gate electrode connected to the scan line GILj. The fourth transistor T4 may be turned on depending on the scan signal GIj received through the scan line GILj and then may perform an initialization operation of initializing a voltage of the gate electrode of the first transistor T1 by supplying the first initialization voltage VINT' to the gate electrode of the first transistor T1.

The fifth transistor T5 includes a first electrode connected to the first voltage line VL1, a second electrode connected to the first electrode of the first transistor T1, and a gate electrode connected to the light-emitting control line EMLj.

The sixth transistor T6 includes a first electrode connected to the second electrode of the first transistor T1, a second electrode connected to the anode of the light-emitting diode ED, and a gate electrode connected to the light-emitting control line EMLj.

The fifth transistor T5 and sixth transistor T6 are simultaneously turned on depending on the light-emitting control signal EMj received through the light-emitting control line EMLj. Accordingly, a current path may be defined between the first voltage line VL1 and the light-emitting diode ED through the fifth transistor T5, the first transistor T1, and the sixth transistor T6.

The seventh transistor T7 includes a first electrode connected to the anode of the light-emitting diode ED, a second electrode connected to the fourth voltage line (also referred to as a first initialization voltage line) VL4, and a gate electrode connected to the scan line GBLj. The seventh transistor T7 is turned on depending on the scan signal GBj received through the scan line GBLj, and bypasses a bypass current Ibp of the anode of the light-emitting diode ED to the fourth voltage line VL4. The seventh transistor T7 may be an initialization transistor that initializes the anode of the light-emitting diode ED in response to the scan signal GBj. The second initialization voltage VINT2 supplied to the fourth voltage line VL4 may be set to a voltage level suitable for initializing the anode of the light-emitting diode ED.

The eighth transistor T8 (also referred to as a switching transistor) includes a first electrode connected to a fifth voltage line VL5 (also referred to as a bias voltage line), a second electrode connected to the first electrode of the first transistor T1, and a gate electrode connected to the scan line GBLj. The eighth transistor T8 may transmit the bias voltage VOBS to the first electrode of the first transistor T1 in response to the scan signal GBj received through the scan line GBLj. The bias voltage VOBS may be set to a voltage level (e.g., about 4 volts (V) to about 5V) suitable for compensating for the hysteresis characteristic of the first transistor T1.

A first terminal of the capacitor Cst is connected to the first voltage line VL1, and a second terminal of the capacitor Cst is connected to the gate electrode of the first transistor T1. The cathode of the light-emitting diode ED may be connected to the second voltage line VL2 that transmits the second driving voltage ELVSS.

Figure 3A:
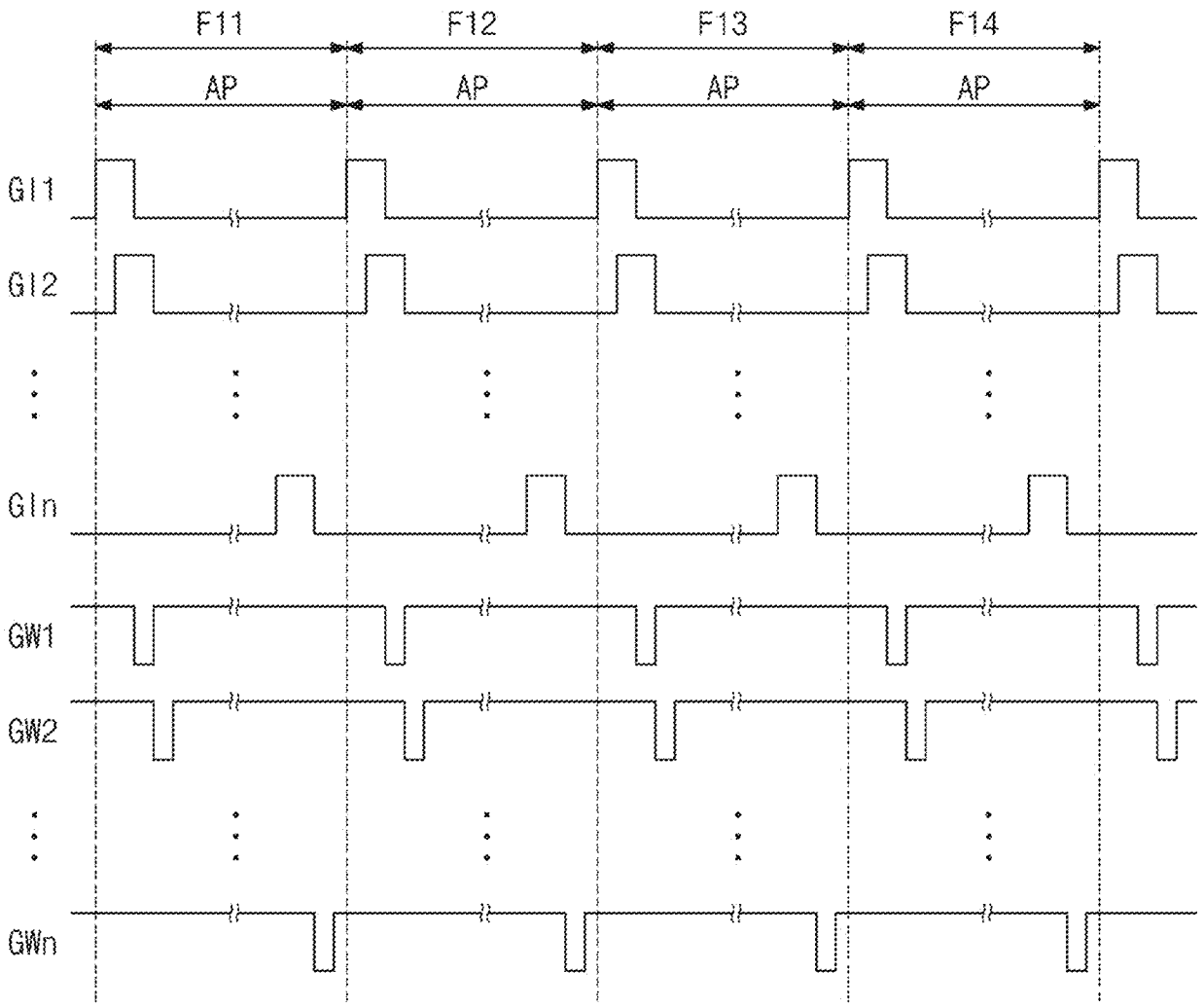
FIGS. 3A, 3B, and 3C are timing diagrams for describing an operation of a display device.
Figure 3B:
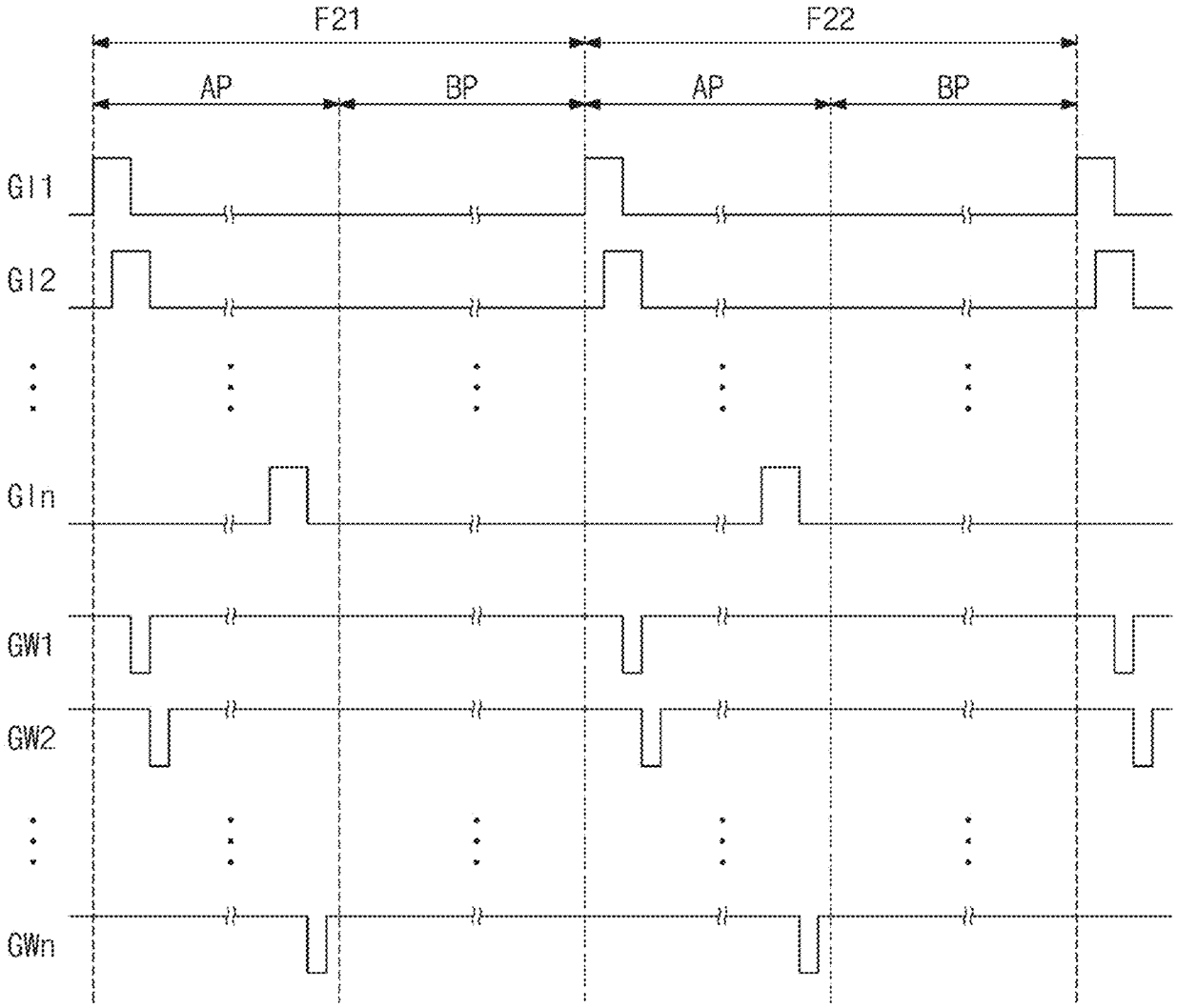
Figure 3C:
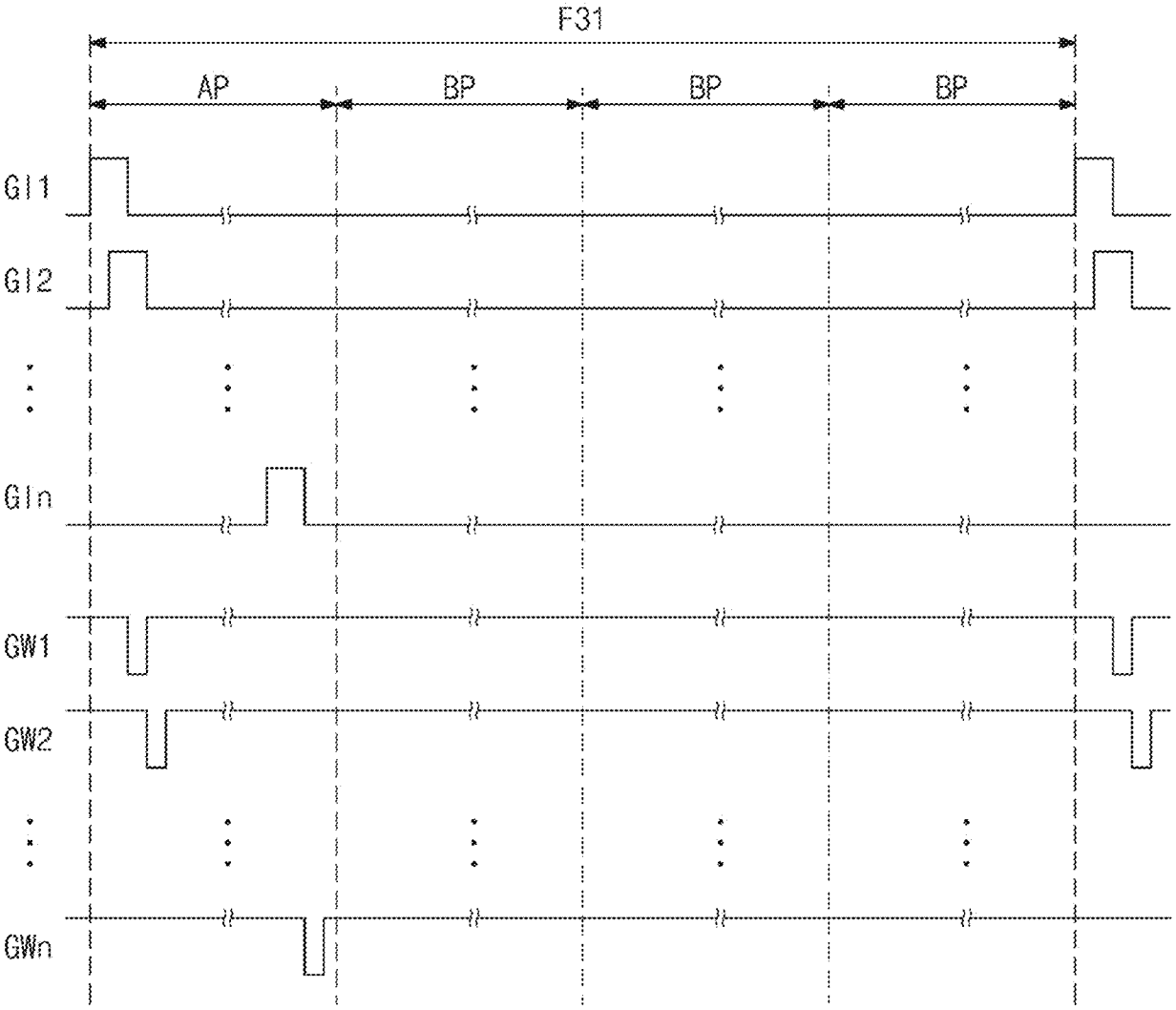

FIGS. 3A, 3B, and 3C are timing diagrams for describing an operation of a display device DD.

Referring to FIGS. 1, 2, 3A, 3B, and 3C, for convenience of description, it is described that the display device DD operates at a first frequency (e.g., about 240 Hz), a second frequency (e.g., about 120 Hz), and a third frequency (e.g., about 60 Hz). However, the invention is not limited thereto. The operating frequency of the display device DD may be changed in various manners. In an embodiment, the operating frequency of the display device DD may be selected as one of a first frequency, a second frequency, and a third frequency depending on the type of the image signal RGB. Besides, the display device DD may not set the operating frequency to a predetermined frequency during an operation, but may change the operating frequency to one of the first to third frequencies at any time.

The driving controller 100 provides the scan control signal SCS to the scan driving circuit SD. The scan control signal SCS may include information about the operating frequency of the display device DD. The scan driving circuit SD may output the scan signals GI1 to GIn, GC1 to GCn, GW1 to GWn, and GB1 to GBn corresponding to operating frequencies in response to the scan control signal SCS.

FIG. 3A is a timing diagram of scan signals when an operating frequency of the display device DD is a first frequency (e.g., about 240 Hz).

Referring to FIGS. 1 and 3A, when the operating frequency is the first frequency (e.g., about 240 Hz), during each of frames F11, F12, F13, and F14, the scan driving circuit SD sequentially activates the scan signals GI1 to GIn to an active level (e.g., a high level) and sequentially activates scan signals GW1 to GWn to an active level (e.g., a low level). In the embodiment shown in FIG. 2, the fourth transistor T4 is an N-type transistor, and thus a high level of each of the scan signals GI1 to GIn is an active level. Moreover, the second transistor T2 is a P-type transistor, a low level of each of the scan signals GW1 to GWn is an active level.

Only the scan signals GI1 to GIn and the scan signals GW1 to GWn are shown in FIG. 3A. However, the scan signals GC1 to GCn and GB1 to GBn and the light-emitting control signals EM1 to EMn may also be sequentially activated during each of the frames F11, F12, F13, and F14.

FIG. 3B is a timing diagram of scan signals when an operating frequency of the display device DD is a second frequency (e.g., about 120 Hz).

Referring to FIGS. 1 and 3B, when the operating frequency is the second frequency (e.g., about 120 Hz), the duration of each of frames F21 and F22 may be twice the duration of each of the frames F11, F12, F13, and F14 shown in FIG. 3A. Each of the frames F21 and F22 may include one active period AP and one blank period BP. During the active period AP, the scan driving circuit SD sequentially activates the scan signals GI1 to GIn, the scan signals GC1 to GCn, the scan signals GW1 to GWn, the scan signals GB1 to GBn, and the light-emitting control signals EM1 to EMn to active levels in a preset order.

FIG. 3B illustrates only the scan signals GI1 to GIn and the scan signals GW1 to GWn. However, the scan signals GC1 to GCn, the scan signals GB1 to GBn, and the light-emitting control signals EM1 to EMn may also be sequentially activated to active levels during the active period AP.

The scan driving circuit SD maintains the scan signals GI1 to GIn and the scan signals GW1 to GWn at inactive levels during the blank period BP. The blank period BP may be also referred to as a "self-scan period".

Although not shown in FIG. 3B, during the blank period BP, the scan driving circuit SD may maintain the scan signals GC1 to GCn at an inactive level (e.g., a low level) and may activate scan signals GB1 to GBn and the light-emitting control signals EM1 to EMn to the active level (e.g., a low level) in a preset order.

In the embodiment shown in FIG. 3A described above, each of the frames F11, F12, F13, and F14 may correspond to an active period AP shown in FIG. 3B.

FIG. 3C is a timing diagram of scan signals when an operating frequency of the display device DD is a third frequency (e.g., about 60 Hz).

Referring to FIGS. 1 and 3C, when the operating frequency is the third frequency (e.g., about 60 Hz), the duration of a frame F31 may be twice the duration of each of the frames F21 and F22 shown in FIG. 3B. The duration of the frame F31 may be four times the duration of each of the frames F11, F12, F13, and F14 shown in FIG. 3A.

The frame F31 may include one active period AP and three blank periods BP. During the active period AP, the scan driving circuit SD sequentially activates the scan signals GI1 to GIn, the scan signals GC1 to GCn, the scan signals GW1 to GWn, the scan signals GB1 to GBn, and the light-emitting control signals EM1 to EMn in a preset order.

FIG. 3C illustrates only the scan signals GI1 to GIn and the scan signals GW1 to GWn. However, the scan signals GC1 to GCn, the scan signals GB1 to GBn, and the light-emitting control signals EM1 to EMn may also be sequentially activated during the active period AP.

The scan driving circuit SD maintains the scan signals GI1 to GIn and the scan signals GW1 to GWn at inactive levels during each of the three blank periods BP.

Although not shown in FIG. 3C, during the blank period BP, the scan driving circuit SD may maintain the scan signals GC1 to GCn at an inactive level (e.g., a low level) and may activate scan signals GB1 to GBn and the light-emitting control signals EM1 to EMn to the active level (e.g., a low level) in a preset order.

Figure 4A:
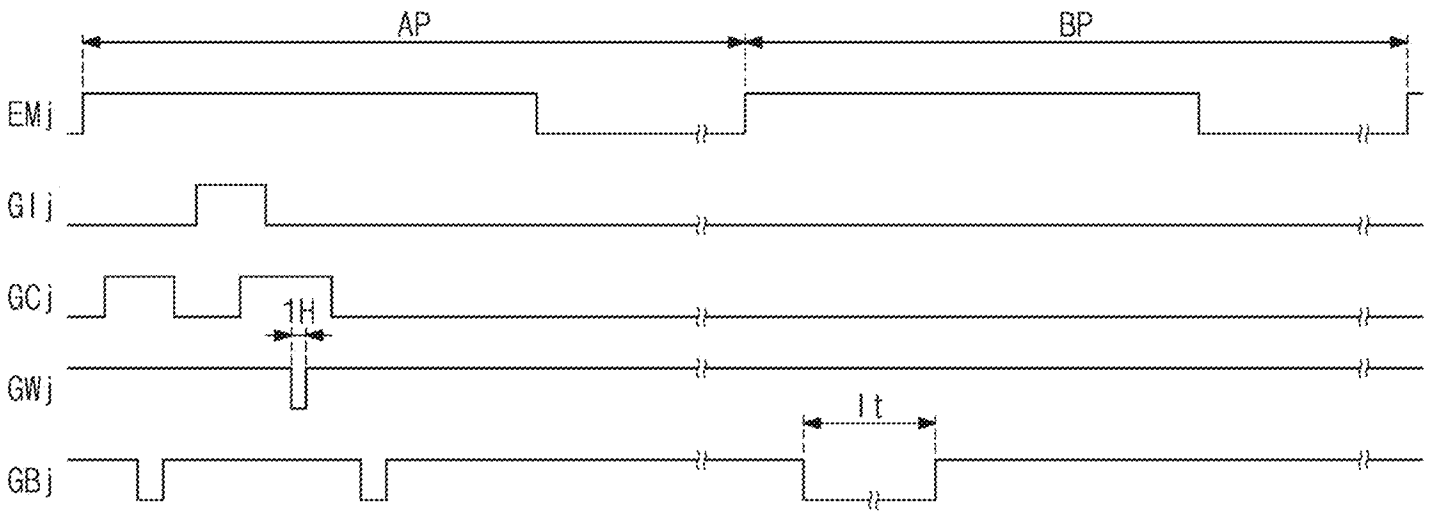
FIGS. 4A and 4B are timing diagrams for describing an operation of a pixel illustrated in FIG. 2.
Figure 4B:
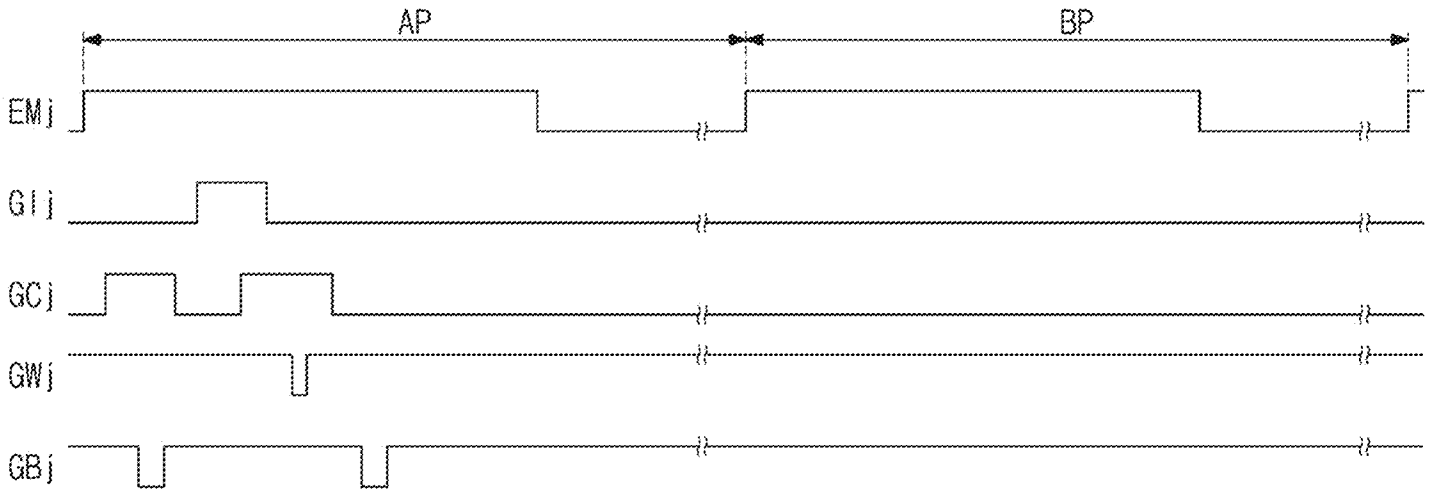

FIGS. 4A and 4B are timing diagrams for describing an operation of a pixel PXij illustrated in FIG. 2.

FIGS. 4A and 4B illustrate scan signals GIj, GCj, GWj, and GBj and the light-emitting control signal EMj provided to the pixel PXij shown in FIG. 2 during each of the active period AP and the blank period BP.

Referring to FIGS. 2 and 4A, when the scan signal GCj having a high level is supplied through the scan line GCLj during the active period AP, the third transistor T3 is turned on. The first transistor T1 is diode-connected by the third transistor T3 turned on and is forward-biased.

When the scan signal GBj having a low level is input through the scan line GBLj, the seventh transistor T7 is turned on. The anode of the light-emitting diode ED is electrically connected to the fourth voltage line VL4 by the seventh transistor T7. A part of the driving current Id may be drained through the seventh transistor T7 as the bypass current Ibp.

Next, the scan signal GIj having a high level is provided through the scan line GILj. When the fourth transistor T4 is turned on in response to the scan signal GIj having a high level, the first initialization voltage VINT1 is supplied to the gate electrode of the first transistor T1 through the fourth transistor T4 so as to initialize the first transistor T1.

When the scan signal GCj having a high level is supplied again through the scan line GCLj, the third transistor T3 is turned on. The first transistor T1 is diode-connected by the third transistor T3 turned on and is forward-biased. At this time, the second transistor T2 is turned on by the scan signal GWj having a low level. In the case, a compensation voltage, which is obtained by reducing the voltage of the data signal Di supplied from the data line DLi by a threshold voltage of the first transistor T1, is applied to the gate electrode of the first transistor T1. That is, a gate voltage applied to the gate electrode of the first transistor T1 may be a compensation voltage.

As the first driving voltage ELVDD and the compensation voltage are respectively applied to opposite ends of the capacitor Cst, a charge corresponding to a difference in voltage between the opposite ends of the capacitor Cst may be stored in the capacitor Cst.

In the meantime, when the scan signal GBj having the low level is transmitted through the scan line GBLj, the seventh transistor T7 is turned on. As the seventh transistor T7 is turned on, the voltage of the anode of the light-emitting diode ED may be initialized to the second initialization voltage VINT2.

When the light-emitting diode ED emits light under the condition that a minimum current of the first transistor T1 flows as a driving current for the purpose of displaying a black image, the black image may not be normally displayed. Accordingly, the seventh transistor T7 in the pixel PXij in an embodiment of the invention may drain (or disperse) a part of the minimum current of the first transistor T1 to a current path, which is different from a current path to the light-emitting diode ED, as the bypass current Ibp. Herein, the minimum current of the first transistor T1 means a current flowing under the condition that a gate-source voltage of the first transistor T1 is smaller than the threshold voltage, that is, the first transistor T1 is turned off. As a minimum driving current (e.g., a current of about 10 pico-amperes (pA) or less) is transmitted to the light-emitting diode ED, with the first transistor T1 turned off, an image of black luminance is expressed. When the minimum driving current displaying a black image flows, the influence of a bypass transfer of the bypass current Ibp may be great. When a large driving current displaying an image such as a normal image or a white image flows, there may be almost no influence of the bypass current Ibp. Accordingly, when a driving current displaying a black image flows, a light-emitting current Ted of the light-emitting diode ED, which corresponds to a result of subtracting the bypass current Ibp drained through the seventh transistor T7 from the driving current Id, may have a minimum current amount to such an extent as to accurately express a black image. Accordingly, a contrast ratio may be improved by implementing an accurate black luminance image by the seventh transistor T7. In an embodiment, the bypass signal is the scan signal GBj having a low level, but is not necessarily limited thereto.

Next, the light-emitting control signal EMj supplied from the light-emitting control line EMLj is changed from a high level to a low level. The fifth transistor T5 and the sixth transistor T6 are turned on by the light-emitting control signal EMj having a low level. In this case, the driving current Id is generated depending on a voltage difference between the gate voltage of the gate electrode of the first transistor T1 and the first driving voltage ELVDD and is supplied to the light-emitting diode ED through the sixth transistor T6, and the light-emitting current led flows through the light-emitting diode ED.

During the blank period BP, each of the scan signals GIj, GCj, and GWj may be maintained at an inactive level. In an embodiment, during the blank period BP, the scan signals GIj and GCj may have a low level, and the scan signal GWj may have a high level, for example.

In the blank period BP, the scan signal GBj has an active level (e.g., a low level) during a preset initialization time duration It. While the scan signal GBj is at an active level, each of the seventh transistor T7 and the eighth transistor T8 are turned on. As the seventh transistor T7 is turned on, the anode of the light-emitting diode ED may be initialized with the second initialization voltage VINT2. As the eighth transistor T8 is turned on, the first electrode of the first transistor T1 may be initialized with the bias voltage VOBS.

Assuming that a time duration in which the scan signal GWj is maintained at an active level (e.g., a low level) during the active period AP is one horizontal period (1H), the initialization time duration It, in which the scan signal GBj is maintained at a low level during the blank period BP, may be several to several tens of horizontal periods.

Referring to FIG. 4B, during the blank period BP, the scan signal GBj may be maintained at an inactive level. That is, during the blank period BP, all of the scan signals GIj, GCj, GWj, and GBj may be maintained at an inactive level.

Figure 5A:
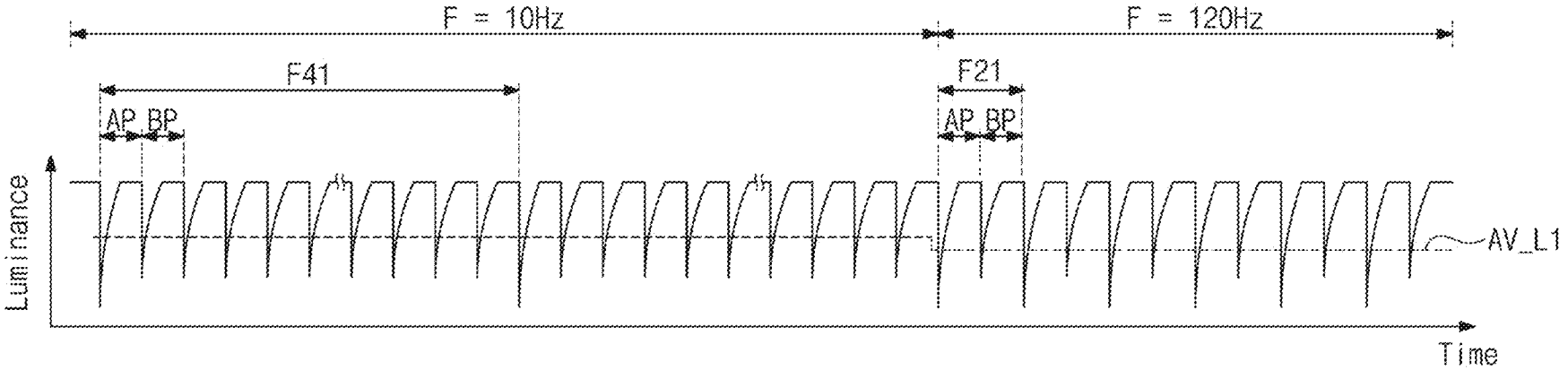
FIGS. 5A and 5B are diagrams illustrating a change in luminance of a display device according to an operating frequency when the same image is displayed.
Figure 5B:
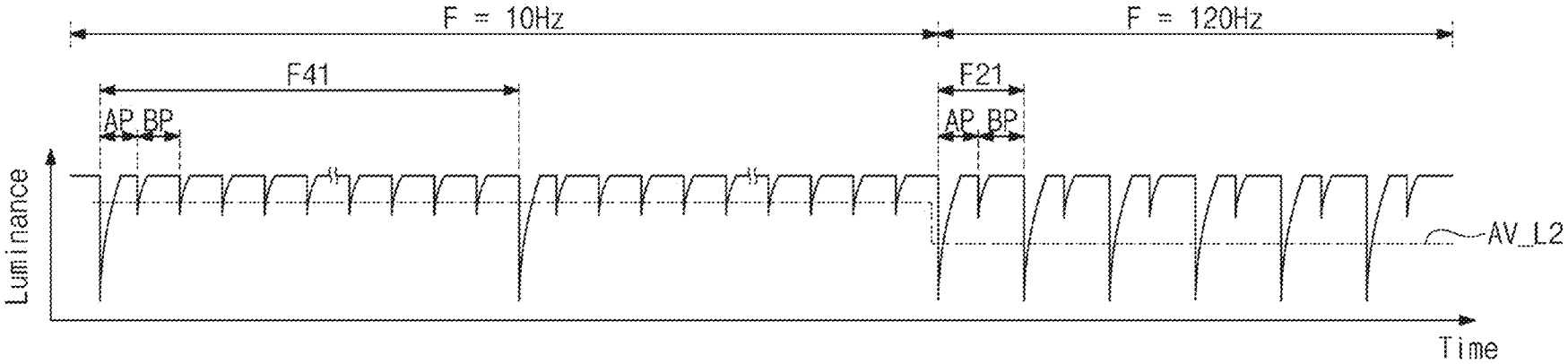

FIGS. 5A and 5B are diagrams illustrating a change in luminance of a display device DD according to an operating frequency F when the same image is displayed.

FIG. 5A illustrates a change in luminance of a display device DD when the scan signal GBj is at an active level during the initialization time duration It in the blank period BP as shown in FIG. 4A.

FIG. 5B illustrates a change in luminance of a display device DD when the scan signal GBj is at an inactive level in the blank period BP as shown in FIG. 4B.

In FIGS. 5A and 5B, F41 indicates one frame when the operating frequency F is about 10 Hz, and F21 indicates one frame when the operating frequency F is about 120 Hz as shown in FIG. 3B. When the operating frequency F is about 120 Hz, the one frame F21 may include one active period AP and one blank period BP. When the operating frequency F is about 10 Hz, the one frame F41 may include one active period AP and 23 blank periods BP.

When the anode of the light-emitting diode ED is initialized during the blank period BP, a change in luminance during the active period AP is similar to a change in luminance during the blank period BP. However, when the anode of the light-emitting diode ED is not initialized during the blank period BP, the change in luminance during the active period AP is different from the change in luminance during the blank period BP.

As shown in FIG. 5A, when the anode of the light-emitting diode ED is initialized during the blank period BP, a variation range of an average luminance AV_L1 of the display device DD is not large when the operating frequency F is changed from about 10 Hz to about 120 Hz.

As shown in FIG. 5B, when the anode of the light-emitting diode ED is not initialized during the blank period BP, a variation range of an average luminance AV_L2 of the display device DD is greater than the variation range of the average luminance AV_L1 shown in FIG. 5A, when the operating frequency F is changed from about 10 Hz to about 120 Hz.

When the luminance of the display device DD varies depending on the operating frequency F even though the same image is displayed, a user perceives that flicker occurs.

Moreover, the luminance of the display device DD may be affected by the voltage level of the second initialization voltage VINT2 and the initialization time duration It in which the scan signal GBj is maintained at an active level during the blank period BP.

Figure 6:
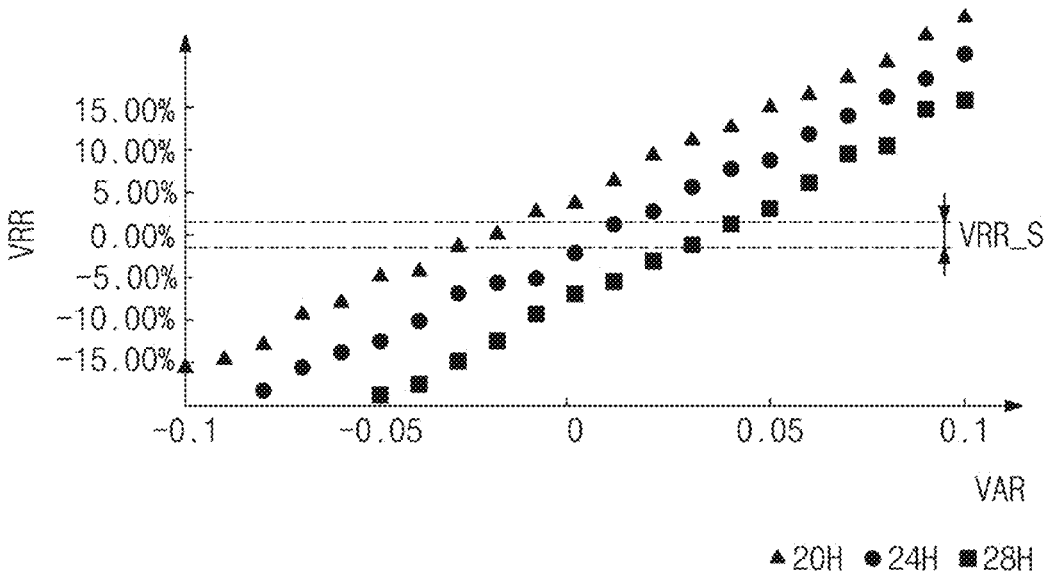
FIG. 6 illustrates a luminance ratio of a display device according to an initialization time duration in which a scan signal is maintained at an active level during a blank period.

FIG. 6 illustrates a luminance ratio VRR of the display device DD according to the initialization time duration It in which the scan signal GBj is maintained at an active level during the blank period BP.

Specifically, FIG. 6 illustrates a change in luminance of a display device DD when the initialization time duration It in which the scan signal GBj is maintained at an active level is twenty horizontal periods (20H), twenty four horizontal periods (24H), or twenty eight horizontal periods (28H) during the blank period BP.

In FIG. 6, a horizontal axis indicates a difference value VAR between the second initialization voltage VINT2 and the first driving voltage ELVDD. In FIG. 6, a vertical axis is a luminance ratio VRR of the luminance of the display device DD in a case that an operating frequency F is a second frequency (e.g., about 120 Hz) to the luminance of the display device DD in a case that the operating frequency F is a first frequency (e.g., about 10 Hz).

As may be seen from FIG. 6, the luminance ratio VRR of the display device DD may vary depending on the difference value VAR between the second initialization voltage VINT2 and the first driving voltage ELVDD and the initialization time duration It in which the scan signal GBj is maintained at an active level during the blank period BP.

It is proper that the luminance ratio VRR of the luminance of the display device DD in a case that an operating frequency F is the second frequency to the luminance of the display device DD in a case that the operating frequency F is the first frequency is between about +1.5% and about −1.5%.

That is, it is proper that the initialization time duration in which the luminance ratio VRR satisfies a criterion of a range VRR_S from about +1.5% to about −1.5% is set to the initialization time duration It of the scan signal GBj.

Figure 7:
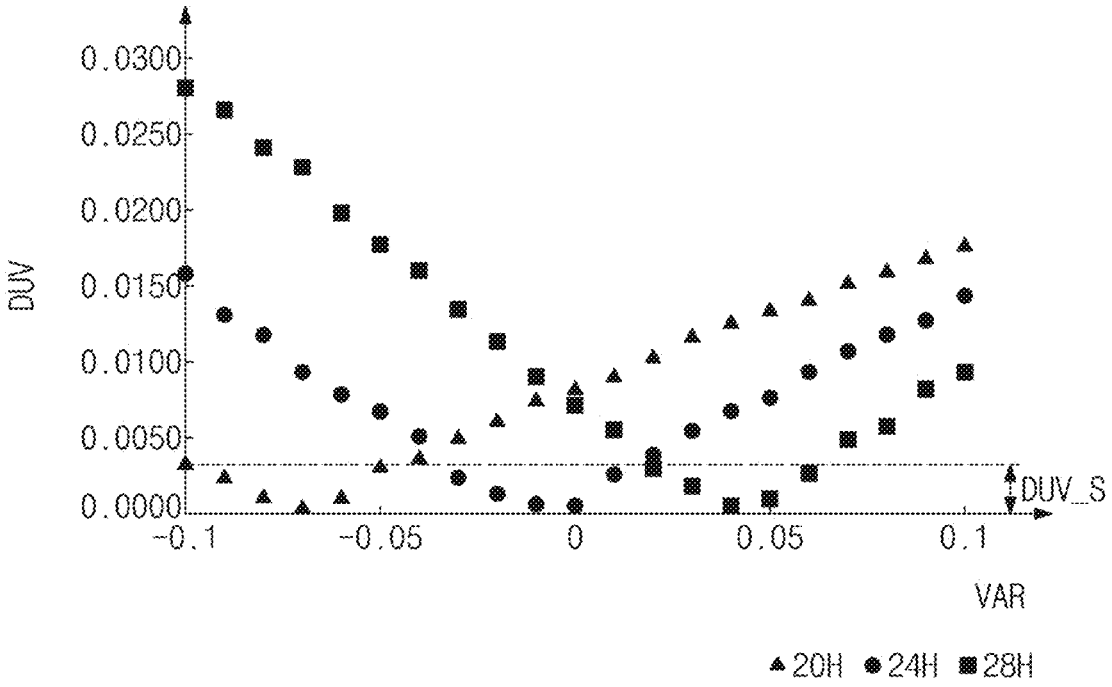
FIG. 7 illustrates a chromaticity deviation of a display device according to an initialization time duration in which a scan signal is maintained at an active level during a blank period.

FIG. 7 illustrates a chromaticity deviation DUV of the display device DD according to the initialization time duration It in which the scan signal GBj is maintained at an active level during the blank period BP.

Specifically, FIG. 7 illustrates a chromaticity deviation DUV of a display device DD when the initialization time duration It in which the scan signal GBj is maintained at an active level is twenty horizontal periods (20H), twenty four horizontal periods (24H), or twenty eight horizontal periods (28H).

In FIG. 7, a horizontal axis indicates a difference value VAR between the second initialization voltage VINT2 and the first driving voltage ELVDD. The vertical axis is the chromaticity deviation DUV of the display device DD.

It is proper that the chromaticity deviation DUV of the display device DD is not greater than about 0.004.

That is, it is proper that the initialization time duration in which the chromaticity deviation DUV satisfies a criterion of a range DUV_S from about 0 to about 0.004 is set to the initialization time duration It of the scan signal GBj.

Furthermore, to set the initialization time duration It of the scan signal GBj to an optimal value, it is necessary to search for the initialization time duration It of the scan signal GBj in which the luminance ratio VRR shown in FIG. 6 satisfies the criterion of the range VRR_S from about +1.5% to about −1.5% and in which the chromaticity deviation DUV shown in FIG. 7 satisfies the criterion of a range DUV_S from about 0 to about 0.004.

In detail, it is necessary to search for the initialization time duration It of the scan signal GBj suitable for a luminance characteristic of the display panel DP when the luminance characteristic of the display device DD are different for each display panel DP.

FIGS. 8A, 8B, 9A, and 9B are diagrams for describing a method of setting the initialization time duration It of the scan signal GBj.

Figure 8A:
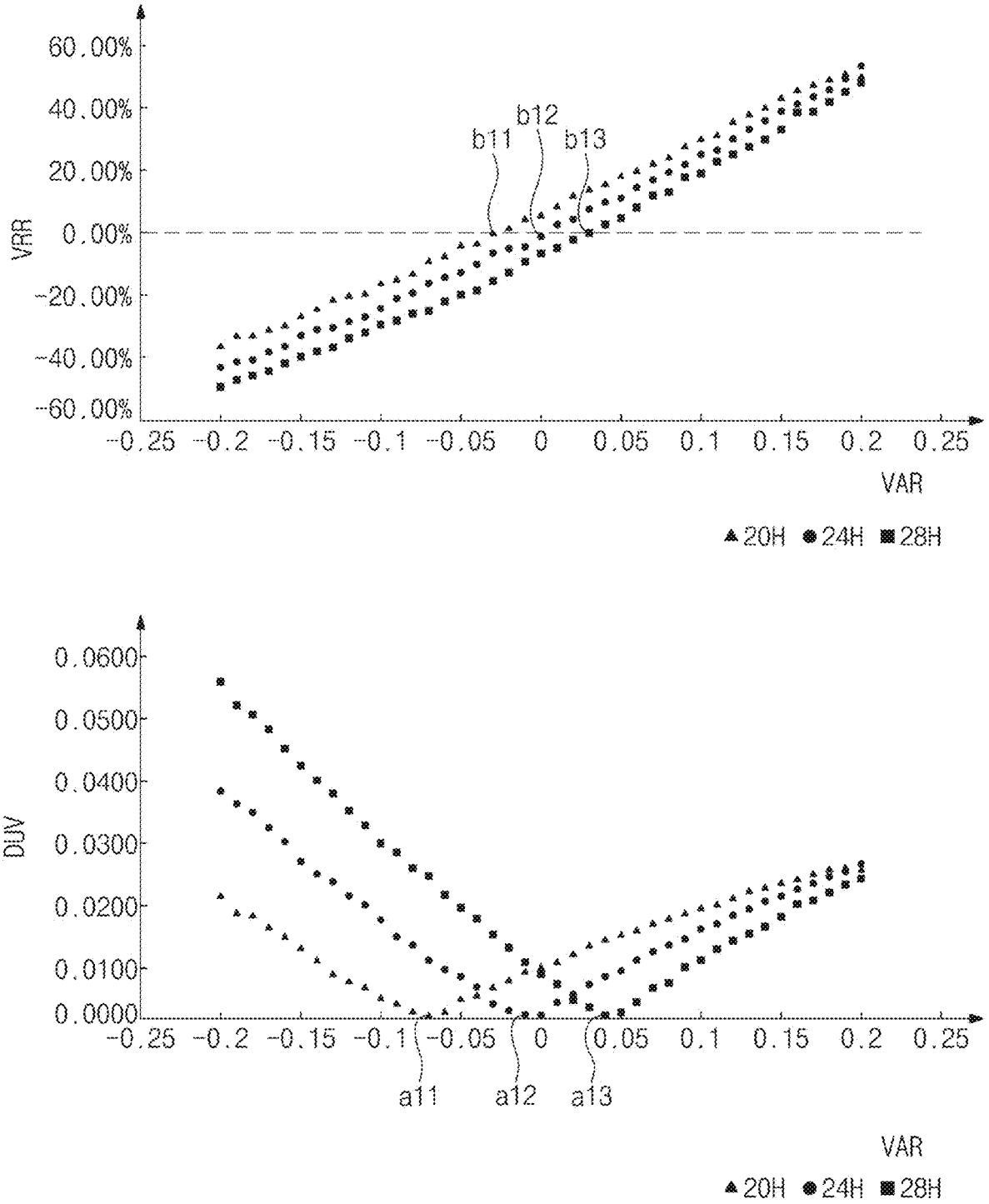
FIGS. 8A, 8B, 9A, and 9B are diagrams for describing a method of setting an initialization time duration of a scan signal.
Figure 8B:
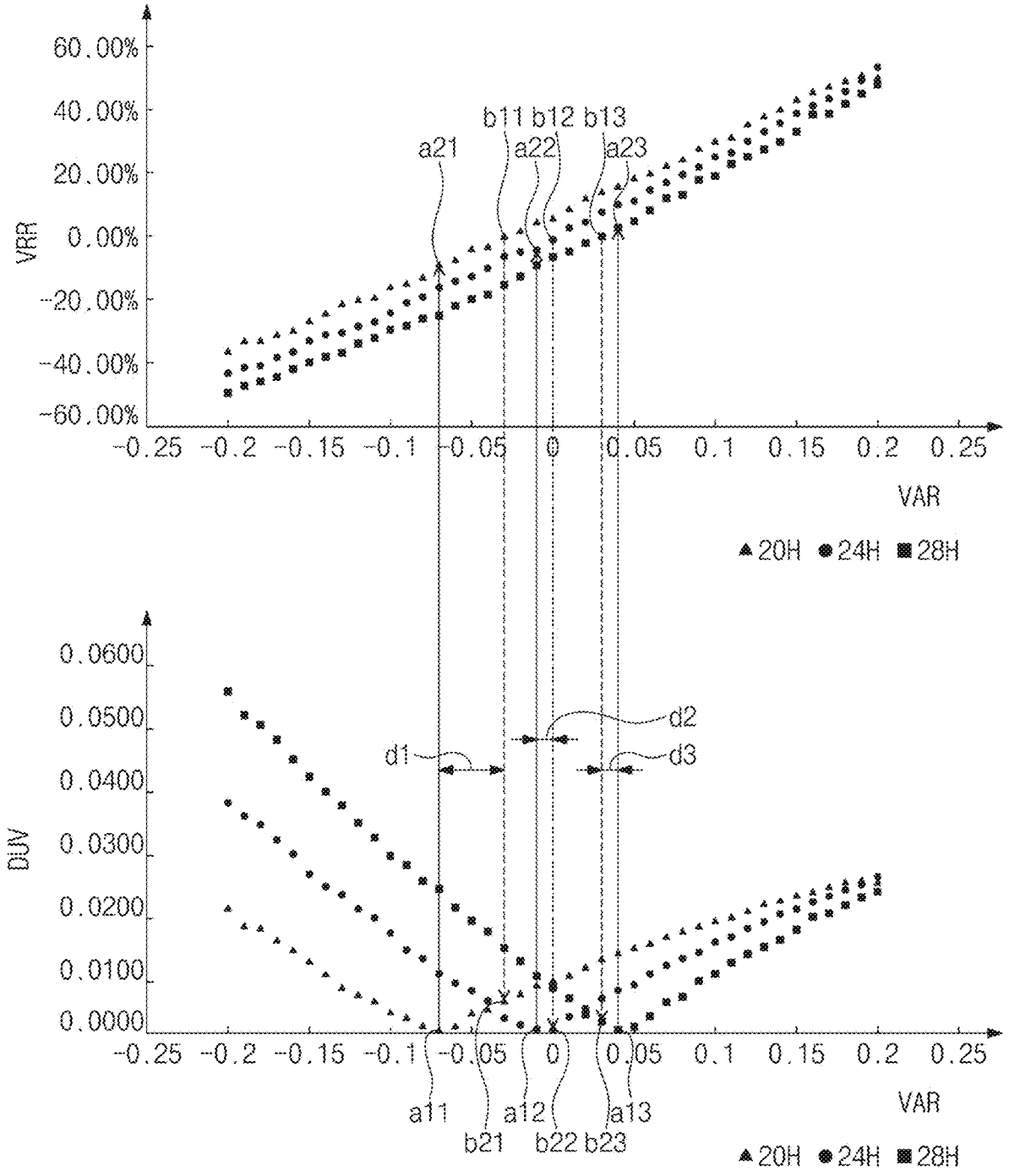

FIGS. 8A and 8B illustrate the luminance ratio VRR and the chromaticity deviation DUV of the display device DD having a luminance characteristic DBV (refer to FIGS. 11 and 12) of 100.

The luminance characteristic DBV means the light emission luminance of the display panel DP (refer to FIG. 1) when the data signal Di provided to the pixel PXij shown in FIG. 2 corresponds to a maximum grayscale. In an embodiment, when the luminance characteristic DBV is 100, the luminance of the display panel DP at a grayscale level of 255 is about 100 nits, for example.

FIGS. 8A and 8B illustrate the luminance ratio VRR and the chromaticity deviation DUV when the data signal Di corresponds to a grayscale level of 15 in the display device DD having the luminance characteristic DBV of 100.

As described In FIG. 6, the luminance ratio VRR is a ratio of the luminance of the display device DD in a case that an operating frequency F is a second frequency (e.g., about 120 Hz) to the luminance of the display device DD in a case that the operating frequency F is a first frequency (e.g., about 10 Hz). Accordingly, it is prefer that the luminance ratio VRR is close to 0%.

As shown in FIG. 8A, when the initialization time duration It of the scan signal GBj is twenty horizontal periods (20H), twenty four horizontal periods (24H), or twenty eight horizontal periods (28H), it is necessary to search for points (b11, b12, b13), at each of which the luminance ratio VRR is closest to 0%.

As described in FIG. 7, it is appropriate that the chromaticity deviation DUV is less than 0.004. However, it is prefer that the chromaticity deviation DUV is close to 0.

Referring to FIG. 8A, when the initialization time duration It of the scan signal GBj is twenty horizontal periods (20H), twenty four horizontal periods (24H), or twenty eight horizontal periods (28H), it is necessary to search for points (a11, a12, a13), at each of which the chromaticity deviation DUV is closest to 0.

As shown in FIG. 8B, it is necessary to search for corresponding points (b21, b22, b23) having the same horizontal period (H) and the same voltage difference VAR as the points (b11, b12, b13) at each of which the luminance ratio VRR is closest to 0%.

Furthermore, it is necessary to search for corresponding points (a21, a22, a23) having the same horizontal period (H) and the same voltage difference VAR as the points (a11, a12, a13) at each of which the chromaticity deviation DUV is closest to 0.

In the embodiment shown in FIG. 8B, the voltage difference VAR between the points (a11, a21) and the points (b11, b21) is d1 when the initialization time duration It is twenty horizontal periods (20H). The voltage difference VAR between the points (a12, a22) and the points (b12, b22) is d2 when the initialization time duration It is twenty four horizontal periods (24H). The voltage difference VAR between the points (a13, a23) and the points (b13, b23) is d3 when the initialization time duration It is twenty eight horizontal periods (28H).

The voltage difference VAR may have a relationship of "d1>d3>d2". In this case, the initialization time duration It of the scan signal GBj may be set to twenty four horizontal periods (24H) having the smallest voltage difference VAR.

Besides, the second initialization voltage VINT2 may be set based on a voltage difference VAR between points (a12, a22) and points (b12, b22) when the initialization time duration It is twenty four horizontal periods (24H). In the embodiment shown in FIGS. 8A and 8B, when the voltage difference VAR is selected as about 0 V, the second initialization voltage VINT2 may be set to the same voltage level as the first driving voltage ELVDD.

Figure 9A:
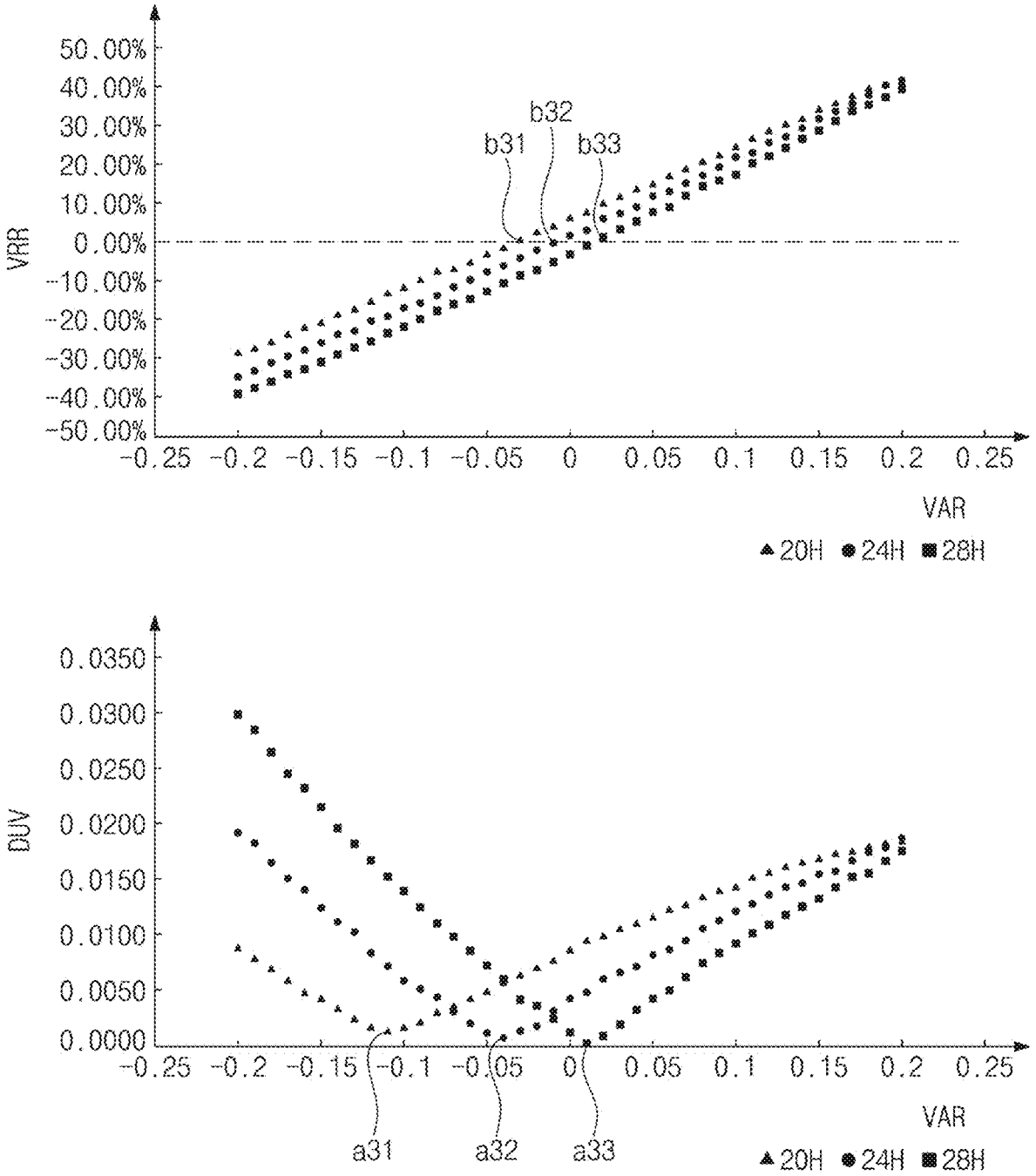
Figure 9B:
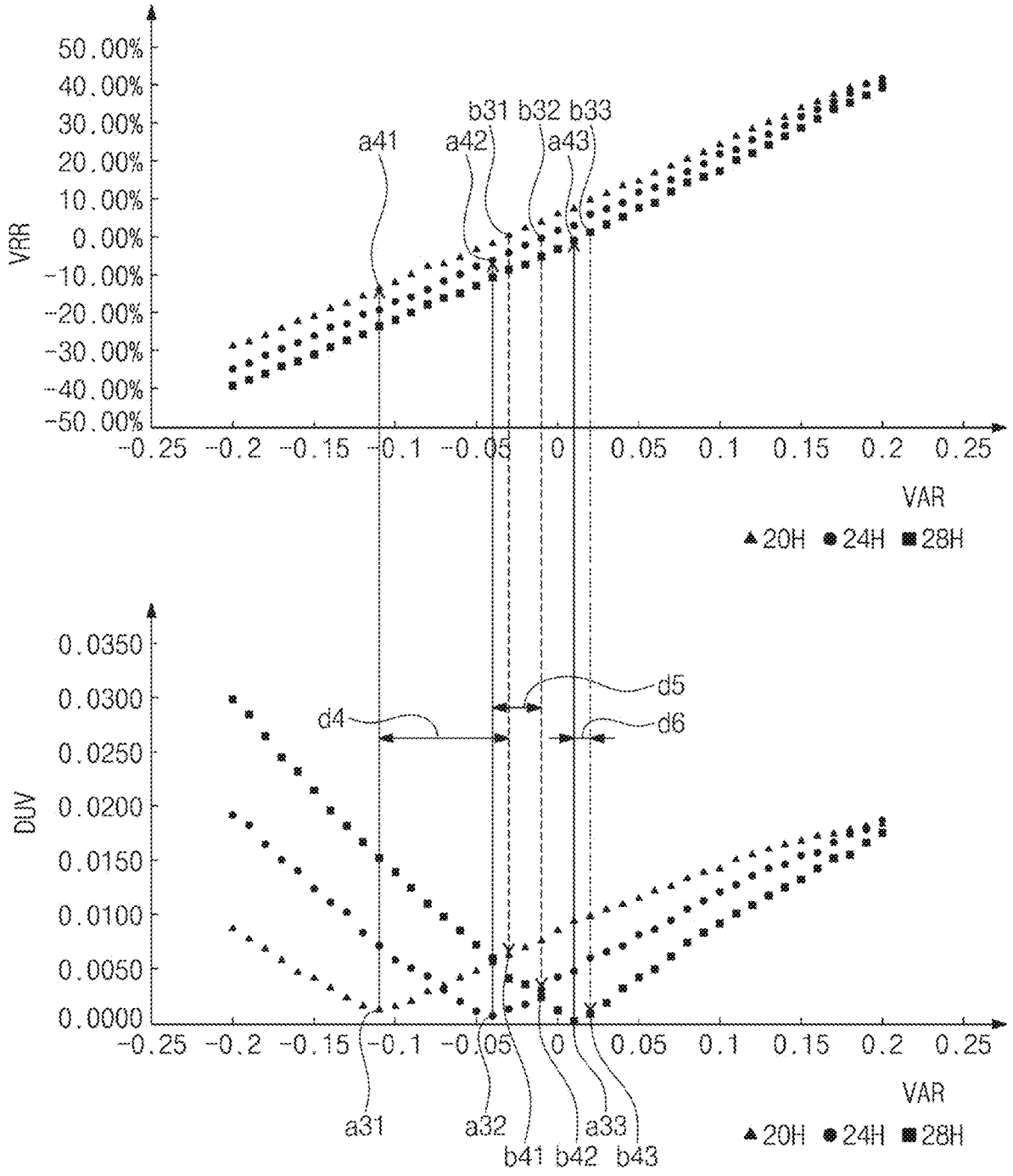

FIGS. 9A and 9B illustrate the luminance ratio VRR and the chromaticity deviation DUV of the display device DD having a luminance characteristic DBV (refer to FIGS. 11 and 12) of 4.

The luminance characteristic DBV means the light emission luminance of the display panel DP (refer to FIG. 1) when the data signal Di provided to the pixel PXij shown in FIG. 2 corresponds to a maximum grayscale. In an embodiment, when the luminance characteristic DBV is 4, the luminance of the display panel DP at a grayscale level of 255 is about 4 nits, for example.

FIGS. 9A and 9B illustrate the luminance ratio VRR and the chromaticity deviation DUV when the data signal Di corresponds to a grayscale level of 15 in the display device DD having the luminance characteristic DBV of 4.

As described In FIG. 6, the luminance ratio VRR is a ratio of the luminance of the display device DD in a case that an operating frequency F is a second frequency (e.g., about 120 Hz) to the luminance of the display device DD in a case that the operating frequency F is a first frequency (e.g., about 10 Hz). Accordingly, it is prefer that the luminance ratio VRR is close to 0%.

As shown in FIG. 9A, when the initialization time duration It of the scan signal GBj is twenty horizontal periods (20H), twenty four horizontal periods (24H), or twenty eight horizontal periods (28H), it is necessary to search for points (b31, b32, b33), at each of which the luminance ratio VRR is closest to 0%.

As described in FIG. 7, it is appropriate that the chromaticity deviation DUV is less than 0.004. However, it is prefer that the chromaticity deviation DUV is close to 0.

As illustrated in FIG. 9A, when the initialization time duration It of the scan signal GBj is twenty horizontal periods (20H), twenty four horizontal periods (24H), or twenty eight horizontal periods (28H), it is necessary to search for points (a31, a32, a33), at each of which the chromaticity deviation DUV is closest to 0.

Referring to FIG. 9B, it is necessary to search for corresponding points (b41, b42, b43) having the same horizontal period (H) and the same voltage difference VAR as the points (b31, b32, b33) at each of which the luminance ratio VRR is closest to 0%.

Furthermore, it is necessary to search for corresponding points (a41, a42, a43) having the same horizontal period (H) and the same voltage difference VAR as the points (a31, a32, a33) at each of which the chromaticity deviation DUV is closest to 0.

In the embodiment shown in FIG. 9B, the voltage difference VAR between the points (a31, a41) and the points (b31, b41) is d4 when the initialization time duration It is twenty horizontal periods (20H). The voltage difference VAR between the points (a32, a42) and the points (b32, b42) is d5 when the initialization time duration It is twenty four horizontal periods (24H). The voltage difference VAR between the points (a33, a43) and the points (b33, b43) is d6 when the initialization time duration It is twenty eight horizontal periods (28H).

The voltage difference VAR may have a relationship of "d4>d5>d6". In this case, the initialization time duration It of the scan signal GBj may be set to twenty eight horizontal periods (28H) having the smallest voltage difference VAR.

Besides, the second initialization voltage VINT2 may be set based on a voltage difference VAR between points (a33, a43) and points (b33, b43) when the initialization time duration It is twenty eight horizontal periods (28H). In the embodiment shown in FIGS. 9A and 9B, when the voltage difference VAR is selected as about 0.02 V, the second initialization voltage VINT2 may be set to a voltage, of which the level is higher than that of the first driving voltage ELVDD by about 0.02V.

Figure 10A:
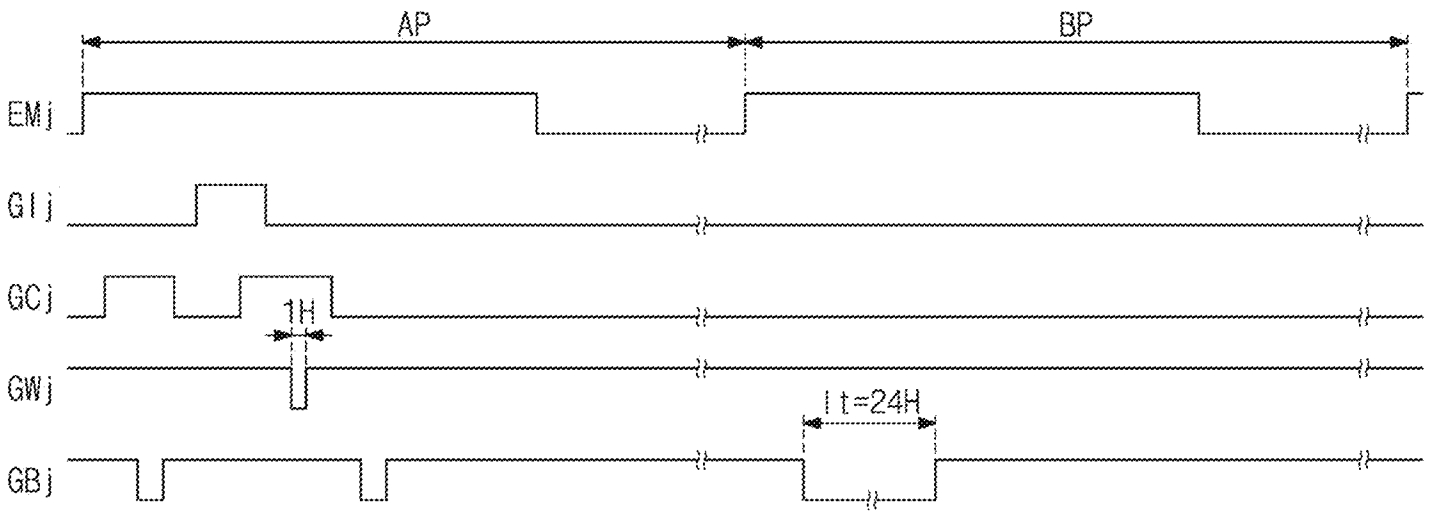
FIGS. 10A and 10B are timing diagrams for describing an operation of a pixel illustrated in FIG. 2.
Figure 10B:
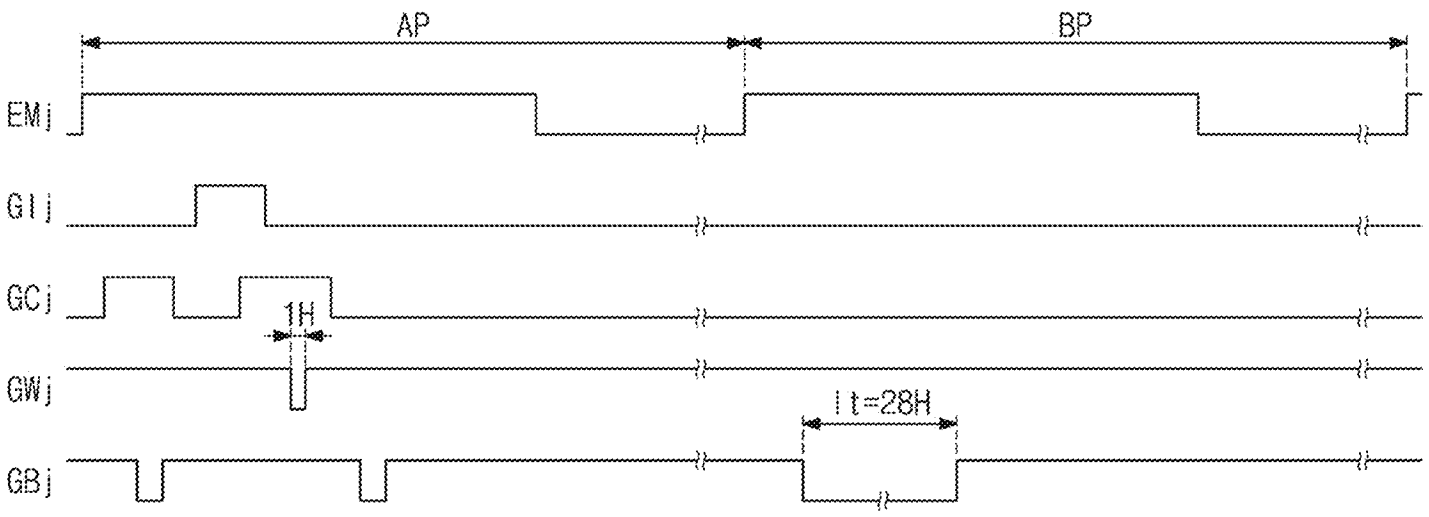

FIGS. 10A and 10B are timing diagrams for describing an operation of a pixel PXij illustrated in FIG. 2.

FIGS. 10A and 10B illustrate the scan signals GIj, GCj, GWj, and GBj and the light-emitting control signal EMj provided to the pixel PXij shown in FIG. 2 during each of the active period AP and the blank period BP.

The timing diagram shown in FIGS. 10A and 10B are similar to the timing diagram shown in FIG. 4A, and thus an additional description will be omitted to avoid redundancy.

Referring to FIG. 10A, as described in FIGS. 8A and 8B, the initialization time duration It at which the scan signal GBj is maintained at an active level (e.g., a low level) during the blank period BP is twenty four horizontal periods (24H).

Referring to FIG. 10B, as described in FIGS. 9A and 9B, the initialization time duration It at which the scan signal GBj is maintained at an active level (e.g., a low level) during the blank period BP is twenty eight horizontal periods (28H).

That is, the initialization time duration It in which the scan signal GBj is maintained at an active level (e.g., a low level) during the blank period BP may be determined depending on the luminance characteristic DBV, the luminance ratio VRR, and the chromaticity deviation DUV of the display panel DP (refer to FIG. 1).

Figure 11:
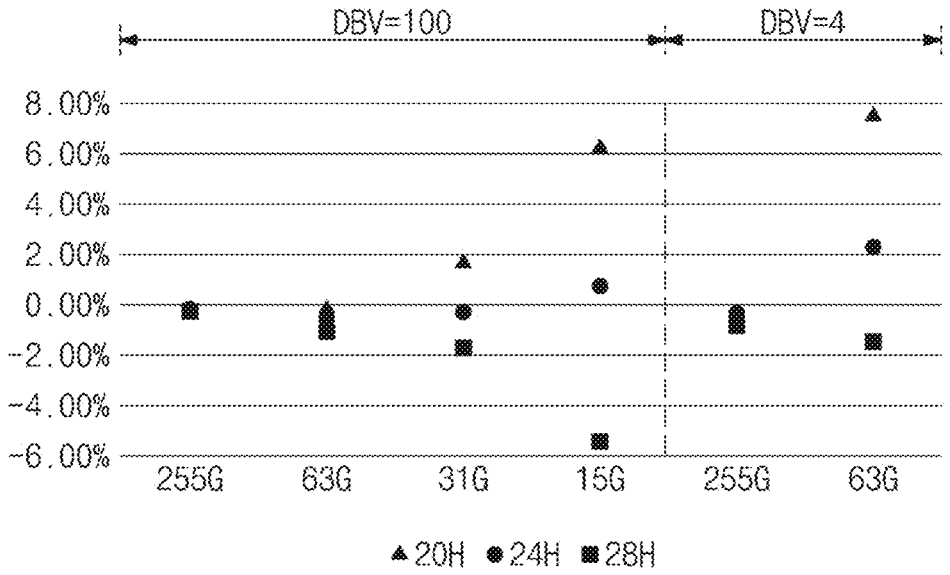
FIG. 11 illustrates a luminance ratio according to an initialization time duration of a scan signal in a display device having a luminance characteristic of 100 and a display device having a luminance characteristic of 4.

FIG. 11 illustrates the luminance ratio VRR according to an initialization time duration It of the scan signal GBj in a display device DD having the luminance characteristic DBV of 100 and a display device DD having the luminance characteristic DBV of 4.

In FIG. 11, a horizontal axis is a grayscale level of the data signal Di provided to the pixel PXij (refer to FIG. 2), and a vertical axis is the luminance ratio VRR.

When the initialization time duration It of the scan signal GBj is twenty four horizontal periods (24H), a display device DD having the luminance characteristic DBV of 100 may satisfy a criterion that the luminance ratio VRR has the range VRR_S from about +1.5% to about −1.5% at all grayscale levels (15G, 31G, 63G, 255G).

When the initialization time duration It of the scan signal GBj is twenty eight horizontal periods (28H), a display device DD having the luminance characteristic DBV of 4 may satisfy a criterion that the luminance ratio VRR has the range VRR_S from about +1.5% to about −1.5% at all grayscale levels (63G, 255G).

Figure 12:
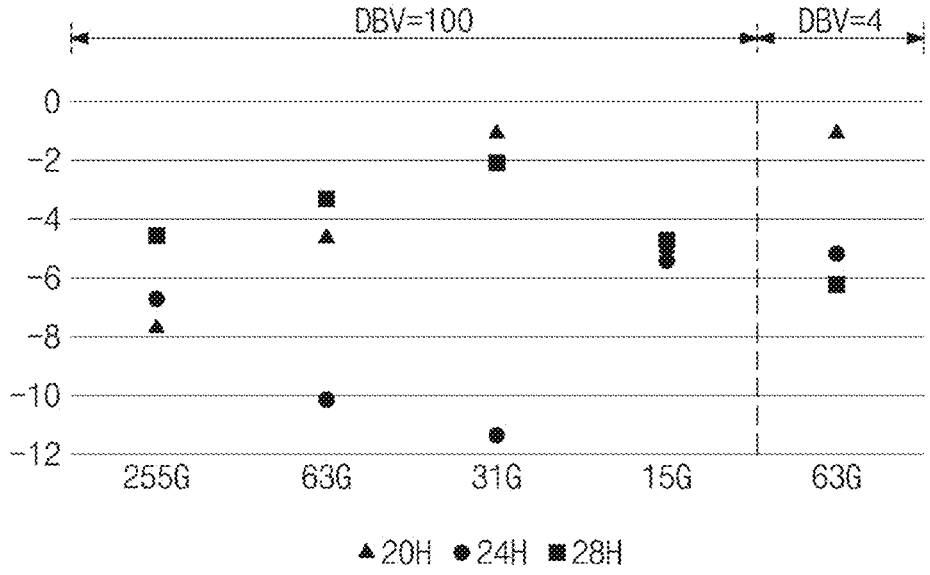
FIG. 12 illustrates a flicker according to an initialization time duration of a scan signal in a display device having a luminance characteristic of 100 and a display device having a luminance characteristic of 4.

FIG. 12 illustrates a flicker according to an initialization time duration It of the scan signal GBj in a display device DD having the luminance characteristic DBV of 100 and a display device DD having the luminance characteristic DBV of 4.

In FIG. 12, a horizontal axis is a grayscale level of the data signal Di provided to the pixel PXij (refer to FIG. 2), and a vertical axis is a flicker index. The flicker index indicates that the amount of flicker perceived by a user. As the flicker index has a lower value, the amount of flicker is small.

When the initialization time duration It of the scan signal GBj is twenty four horizontal periods (24H), a display device DD having the luminance characteristic DBV of 100 has a lower flicker index than twenty horizontal periods (20H) and twenty eight horizontal periods (28H) at each of grayscale levels (15G, 31G, 63G).

When the initialization time duration It of the scan signal GBj is twenty eight horizontal periods (28H), a display device DD having the luminance characteristic DBV of 4 has a lower flicker index than twenty horizontal periods (20H) and twenty four horizontal periods (24H) at a grayscale level (255G).

Although described above with reference to a preferred embodiment of the invention, it will be understood by those skilled in the art that various modifications and changes may be made in the invention without departing from the spirit and scope of the invention as set forth in the appended claims. Accordingly, the technical scope of the invention should not be limited to the contents described in the detailed description of the specification, but should be defined by the claims.

A display device having such a configuration periodically initializes the voltage of an anode of a light-emitting diode at a low operating frequency. Accordingly, a difference in luminance of a display image may be prevented from being perceived by a user at a low operating frequency and a high operating frequency.

In detail, the quality of the display image may be improved by optimizing a time duration to initialize a voltage of the anode of the light-emitting diode at a low operating frequency depending on a feature of a display panel.

While the invention has been described with reference to embodiments thereof, it will be apparent to those of ordinary skill in the art that various changes and modifications may be made thereto without departing from the spirit and scope of the invention as set forth in the appended claims.

What is claimed is:

1. A display device comprising:

a plurality of scan lines;

a data line;

a display panel including a pixel connected to the plurality of scan lines and the data line, the pixel including:

a light-emitting diode including a first electrode and a second electrode; and an initialization transistor connected between a first initialization voltage line and the first electrode of the light-emitting diode and including a gate electrode connected to a first scan line among the plurality of scan lines;

a scan driving circuit which outputs a plurality of scan signals to the plurality of scan lines, respectively;

a data driving circuit which outputs a data signal to the data line during an active period; and a driving controller which controls the scan driving circuit and the data driving circuit, wherein a first scan signal among the plurality of scan signals provided to the first scan line during a blank period has an active level during a predetermined initialization time duration, and the predetermined initialization time duration is set to a time duration corresponding to a luminance characteristic of the display panel so that the predetermined initialization time duration has different values corresponding to different values of the luminance characteristic of the display panel.

2. The display device of claim 1, wherein, when the luminance characteristic of the display panel has a first value, the predetermined initialization time duration of the first scan signal has a first time duration during the blank period, and wherein, when the luminance characteristic of the display panel has a second value different from the first value, the predetermined initialization time duration of the first scan signal has a second time duration different from the first time duration during the blank period.

3. The display device of claim 1, wherein an initialization voltage provided to the first initialization voltage line has a voltage level corresponding to the luminance characteristic of the display panel.

4. The display device of claim 3, wherein, when the luminance characteristic of the display panel has a first value, the initialization voltage has a first voltage level, and wherein, when the luminance characteristic of the display panel has a second value different from the first value, the initialization voltage has a second voltage level different from the first voltage level.

5. The display device of claim 1, wherein the pixel further includes:

a first transistor including a first electrode, a second electrode electrically connected to the first electrode of the light-emitting diode, and a gate electrode; and a switching transistor including a first electrode connected to a bias voltage line, a second electrode connected to the first electrode of the first transistor, and a gate electrode connected to the first scan line.

6. The display device of claim 5, wherein the pixel further includes:

a second transistor including a first electrode connected to the data line, a second electrode connected to the first electrode of the first transistor, and a gate electrode connected to a second scan line among the plurality of scan lines;

a third transistor including a first electrode connected to the second electrode of the first transistor, a second electrode connected to the gate electrode of the first transistor, and a gate electrode connected to a third scan line among the plurality of scan lines;

a fourth transistor including a first electrode connected to the gate electrode of the first transistor, a second electrode connected to a second initialization voltage line, and a gate electrode connected to a fourth scan line among the plurality of scan lines;

a fifth transistor including a first electrode connected to a voltage line, a second electrode connected to the first electrode of the first transistor, and a gate electrode for receiving a light-emitting control signal;

a sixth transistor including a first electrode connected to the second electrode of the first transistor, a second electrode connected to the first electrode of the light-emitting diode, and a gate electrode for receiving the light-emitting control signal; and a capacitor including a first terminal connected to the voltage line and a second terminal connected to the gate electrode of the first transistor.

7. The display device of claim 6, wherein at least one of the first transistor, the second transistor, the third transistor, the fourth transistor, the fifth transistor, the sixth transistor, the initialization transistor, and the switching transistor is an N-type transistor, and remaining transistors of the first transistor, the second transistor, the third transistor, the fourth transistor, the fifth transistor, the sixth transistor, the initialization transistor, and the switching transistor are P-type transistors.

8. The display device of claim 6, wherein each of the first transistor, the second transistor, the fifth transistor, the sixth transistor, the initialization transistor, and the switching transistor is a P-type transistor, and each of the third transistor and the fourth transistor is an N-type transistor.

9. The display device of claim 6, wherein each of a second scan signal, a third scan signal, and a fourth scan signal among the plurality of scan signals, which are respectively provided to the second scan line, the third scan line, and the fourth scan line, is at an inactive level during the blank period.

10. The display device of claim 6, wherein a second scan signal among the plurality of scan signals provided to the second scan line is at an active level during one horizontal period in the active period, and wherein the predetermined initialization time duration of the first scan signal provided to the first scan line during the blank period is longer than the one horizontal period.

11. The display device of claim 10, wherein, when an operating frequency of the second scan signal is a first frequency, one frame includes the active period, and wherein, when the operating frequency of the second scan signal is a second frequency lower than the first frequency, one frame includes the active period and the blank period.

12. A display device comprising:

a plurality of scan lines;

a data line;

a display panel including a pixel connected to the plurality of scan lines and the data line, the pixel including:

a light-emitting diode including a first electrode and a second electrode;

an initialization transistor connected between a first initialization voltage line and the first electrode of the light-emitting diode and including a gate electrode connected to a first scan line among the plurality of scan lines;

a first transistor including a first electrode, a second electrode electrically connected to the first electrode of the light-emitting diode, and a gate electrode; and a second transistor including a first electrode connected to the data line, a second electrode connected to the first electrode of the first transistor, and a gate electrode connected to a second scan line among the plurality of scan lines;

a scan driving circuit which outputs a plurality of scan signals to the plurality of scan lines, respectively;

a data driving circuit which outputs a data signal to the data line; and a driving controller which controls the scan driving circuit and the data driving circuit, wherein one frame includes an active period and a blank period, and wherein a first scan signal provided to the first scan line among the plurality of scan signals during the blank period has an active level during a predetermined initialization time duration, and the predetermined initialization time duration is set to a time duration corresponding to a luminance characteristic of the display panel.

13. The display device of claim 12, wherein, when the luminance characteristic of the display panel has a first value, the predetermined initialization time duration of the first scan signal has a first time duration during the blank period, and wherein, when the luminance characteristic of the display panel has a second value different from the first value, the predetermined initialization time duration of the first scan signal has a second time duration different from the first time duration during the blank period.

14. The display device of claim 12, wherein an initialization voltage provided to the first initialization voltage line has a voltage level corresponding to the luminance characteristic of the display panel.

15. The display device of claim 14, wherein, when the luminance characteristic of the display panel has a first value, the initialization voltage has a first voltage level, and wherein, when the luminance characteristic of the display panel has a second value different from the first value, the initialization voltage has a second voltage level different from the first voltage level.

16. The display device of claim 12, wherein the pixel further includes:

a switching transistor including a first electrode connected to a bias voltage line, a second electrode connected to the first electrode of the first transistor, and a gate electrode connected to the first scan line.

17. The display device of claim 16, wherein the pixel further includes:

a third transistor including a first electrode connected to the second electrode of the first transistor, a second electrode connected to the gate electrode of the first transistor, and a gate electrode connected to a third scan line among the plurality of scan lines;

a fourth transistor including a first electrode connected to the gate electrode of the first transistor, a second electrode connected to a second initialization voltage line, and a gate electrode connected to a fourth scan line among the plurality of scan lines;

a fifth transistor including a first electrode connected to a voltage line, a second electrode connected to the first electrode of the first transistor, and a gate electrode for receiving a light-emitting control signal;

a sixth transistor including a first electrode connected to the second electrode of the first transistor, a second electrode connected to the first electrode of the light-emitting diode, and a gate electrode for receiving the light-emitting control signal; and a capacitor including a first terminal connected to the voltage line and a second terminal connected to the gate electrode of the first transistor.

18. The display device of claim 17, wherein at least one of the first transistor, the second transistor, the third transistor, the fourth transistor, the fifth transistor, the sixth transistor, the initialization transistor, and the switching transistor is an N-type transistor, and remaining transistors of the first transistor, the second transistor, the third transistor, the fourth transistor, the fifth transistor, the sixth transistor, the initialization transistor, and the switching transistor are P-type transistors.

19. The display device of claim 17, wherein each of a second scan signal, a third scan signal, and a fourth scan signal, which are respectively provided to the second scan line, the third scan line, and the fourth scan line, is at an inactive level during the blank period.

20. The display device of claim 12, wherein a second scan signal provided to the second scan line is at an active level during one horizontal period in the active period, and wherein the predetermined initialization time duration of the first scan signal provided to the first scan line during the blank period is longer than the one horizontal period.

* * * * *